US008933315B2

(12) United States Patent
Marquez et al.

(10) Patent No.: US 8,933,315 B2
(45) Date of Patent: Jan. 13, 2015

(54) IMPACT RESPONSIVE PORTABLE ELECTRONIC DRUMHEAD

(75) Inventors: Ronald G. Marquez, Yorba Linda, CA (US); Franklin N. Eventoff, Bow, WA (US); Mario J. DeCiutis, Chicopee, MA (US)

(73) Assignees: Aquarian Coatings Corp., Anaheim, CA (US); Miditronix LLC, Bow, WA (US)

( * ) Notice: Subject to any disclaimer, the term of this patent is extended or adjusted under 35 U.S.C. 154(b) by 187 days.

(21) Appl. No.: 13/530,289

(22) Filed: Jun. 22, 2012

(65) Prior Publication Data

US 2013/0340598 A1 Dec. 26, 2013

(51) Int. Cl.
*G10H 1/32* (2006.01)
*G10H 3/00* (2006.01)

(52) U.S. Cl.
USPC ..... 84/743; 84/723; 84/104; 84/107; 84/411 R

(58) Field of Classification Search
CPC ..... G01L 1/205; G01L 5/228; G01L 1/20; G01L 5/0009; H01H 2215/052; H01H 35/14; G10H 2220/561; G10H 3/146; G10H 1/0555; G10H 1/32; G10H 2220/525; G10H 2230/275; G10H 3/14; G10H 9/002; G01R 29/14; H01C 3/00
See application file for complete search history.

(56) References Cited

U.S. PATENT DOCUMENTS

| | | | | |
|---|---|---|---|---|
| 5,998,716 | A * | 12/1999 | Marquez et al. | 84/411 P |
| 6,032,536 | A * | 3/2000 | Peeters et al. | 73/725 |
| 7,926,351 | B2 * | 4/2011 | Masaki et al. | 73/718 |
| 8,173,886 | B2 * | 5/2012 | Hashimoto | 84/723 |
| 8,266,971 | B1 * | 9/2012 | Jones | 73/862.046 |
| 2009/0151475 | A1 * | 6/2009 | Masaki et al. | 73/862.68 |
| 2012/0011989 | A1 * | 1/2012 | Takahashi | 84/626 |
| 2013/0340598 | A1 * | 12/2013 | Marquez et al. | 84/730 |

* cited by examiner

*Primary Examiner* — Marlon Fletcher
(74) *Attorney, Agent, or Firm* — William L. Chapin

(57) ABSTRACT

A portable electronic drumhead includes a sensor responsive to drumstick impacts in producing electrical signal pulses input to headphones to thereby simulate sounds of an acoustic drumhead. The sensor includes a Force Sensing Resistor (FSR) lamination coated with an electrically conductive polymer ink, a spacer lamination, and a flexible electrode lamination having on an inner surface thereof a pair of interdigitated electrodes, the electrode lamination elastically contacting the FSR lamination in response to drumstick impacts on the outer surface of the electrode lamination or FSR lamination to thus momentarily reduce electrical resistance between the electrodes. Resilient batter pads overlying the laminations muffle sounds produced by drumstick impacts. Optionally, the sensor may have an annular ring shape which may be placed concentrically on the head of an acoustic drum, the sensor having an upwardly protruding resilient bumper strikable to produce electronically synthesized rim shot sounds.

41 Claims, 18 Drawing Sheets

280
285L
285R
272L
284
276
257
309R
302L
305L
306L
304L
307L
281
282
309L
299
220
275
277
274
272
235
236
276
17C
285
285R
272R
272L
273
291
-238-
295L
304R
276
295R
295L
293
294
17D
272R
308L
308R
308L
302R
302L
304L
304R

IMPACT RESPONSIVE PORTABLE ELECTRONIC DRUMHEAD

BACKGROUND OF THE INVENTION

A. Field of the Invention

The present invention relates to percussion musical instruments, particularly drums and drumheads and, specifically to a portable electronic drumhead which is uniformly responsive to barely audible drumstick impacts over its entire upper surface in producing electronic signals which are clearly audible in earphones as realistic simulations of percussion drumhead impact sounds.

B. Description of Background Art

A variety of acoustic drums have long been used by orchestras, bands and other musical groups. Drum types commonly used by musicians include kettle drums, also known as tympani, base or kick drums, snare drums and tomtoms. All acoustic drums include a drum head at one or both ends of a hollow cylindrical shell. The drumheads usually consist of a thin membrane made from an animal skin or synthetic polymer. The membrane is held in tension over the open end of the shell, and the outer surface of the membrane is used as a striking or batter surface which is struck by drumstick, mallet fingers or hand, causing the drumhead on an air column within the shell to vibrate at audible frequencies.

For various reasons, traditional acoustic drums are sometimes supplemented with or replaced by electronic devices. Thus, for some applications, the sounds produced by even small drums are too loud for the particular acoustic environment, and/or a particular event. In such cases, acoustic drums are sometimes fitted with passive sound attenuating accessories such as batter pads, and one or more electronic transducers which convert the sound vibrations of the drum produced by a drumstick impacting a drumhead into electronic signals. These signals are then input to an electronic signal processing device which amplifies or attenuates the drumhead vibrations to adjustable volume-level drive signals which are input to one or more loudspeakers. More elaborate signal processing devices are also used which can convert vibration signals produced by an impacting drumstick into sounds.

In addition to the transducers and electronic signal conditioning or signal processing devices which are presently available for use with acoustic drums, there are available a variety of electronic drum simulators. These devices essentially do away with the requirement for the shells or other acoustically resonant parts of acoustic drums, and require only a thin transducer pad which is struck by drumsticks, hands, or other objects. The transducer pads contain transducers which convert impact forces, pressure, or vibrations into electrical signals that vary in amplitude and frequency proportionally to the impact forces. The electrical signals are input to a signal processing unit which usually includes an audio amplifier which has user-controllable variable gain and has an output power lever sufficient to drive headphones or loudspeakers. Usually, the signal processing units of portable electronic drumheads include electronic wave fillers having frequency response characteristics which are also adjustable by a user.

Portable electronic drumheads of the type described above are useable both in musical performances, and for practice by a drummer, who may use earphones plugged into an earphone output of the signal processing unit to enable the drummer to practice in quiet environments without disturbing others.

In view of the advantages afforded by electronic accessories and replacements for purely acoustic drums as described above, Eventoff and DeCiutis, two of the three co-inventors of the present invention, disclosed a 'Hybrid Drum" in U.S. patent application Ser. No. 12/910,524 filed Oct. 22, 2010, published on Apr. 26, 2012 as US 2012/0097009. The Eventoff application discloses a replacement drumhead for conventional acoustic drums, the drumhead having multiple layers including a first upper layer having an electrically conductive lower surface, a second layer having an electrically conductive upper surface, and a third, Force Sensing Resistor (FSR) resistor layer which is located between the first and second layers and has an electrical resistance which varies with force or impact pressure on the upper surface of the first, upper layer. According to the invention, a pair of electrically conductive strips arranged in an interdigitated spiral or concentric pattern is deposited on one or both of the inner facing surfaces of the upper and lower layers. The two conductors have a pair of leads which extend radially outwards from the outer circumferential edge of the drumhead, where they are electrically conductively coupled to input terminal pair of an input port of an electronic signal processing unit. According to the disclosure of Eventoff, the multi-layer drumhead is positioned on the open head of a drum shell, and clamped in tension on the open upper end of the shell in a conventional fashion. A tail containing the electrode leads extends radially outwards and downwards from the outer circumferential edge of the drumhead to an electronic signal processing box which is attached to the outer cylindrical wall surface of the drum shell.

The material composition of the upper and lower layers of the drumhead in Eventoff are not disclosed. However, since the tension required in drum heads is quire substantial, the upper and lower layers must be made of a relatively high strength material, such as a polyester or PET. Such materials can not only resist breakage under the high tensions required for drums, but also can stretch in response to tension without breaking. The Hybrid Drumhead disclosed in Eventoff affords significant advantages over prior art electronic drums which use piezoelectric acoustic transducers, because the FSR layer is an integral, internal part of the drumhead. Thus, the Hybrid Drumhead disclosed in Eventoff responds only to impacts on the drumhead, and is therefore insensitive to extraneous vibrations or sounds which can cause false triggering of electronic signal processing circuitry which receives input from an acoustic transducer. Moreover, since the FSR sensor layer of Eventoff is distributed over the entire playing surface of the drumhead, the drumhead is uniformly responsive to drumstick impacts over the entire drumhead. However, a need remained for a portable electronic drumhead which possessed advantages of the Hybrid Drumhead described in Eveloff, but did not require a drum body. That need was a motivating factor for the present invention.

OBJECTS OF THE INVENTION

An object of the present invention is to provide a portable electronic drumhead which is useable on a table top or similar support surface.

Another object of the invention is to provide a portable electronic drumhead that includes a sensor whose electrical resistance varies in response to impacts of drumsticks on the drumhead.

Another object of the invention is to provide a portable electronic drumhead which includes an impact sensor assembly that has a force sensing resistor (FSR) lamination substrate which has on the upper surface thereof a force sensing resistor (FSR) layer, and a second upper electrode lamination substrate which has on a lower surface thereof a pair of sensor electrodes consisting of electrically conductive strips which contact the FSR layers, the electrode strips being connected to a pair of lead-out conductors, which have therebetween an electrical resistance which thus varies in response to drumstick impacts on the upper surface of the electrode lamination substrate.

Another object of the invention is to provide an impact responsive portable electronic drumhead which has an FSR lamination including a substrate which has on a flat upper surface thereof a coating of an electrically conductive material consisting of a polymer ink whose electrical resistance varies as a function of normal force exerted on the coating by a pair of spaced apart electrodes which contact the coating, and an electrode lamination which includes a substrate having on a lower flat surface thereof a pair of electrode conductor strips which contact the FSR layer, the electrode strips being connected to a pair of lead-out conductors which are connectable in series with a voltage source and a fixed resistor to thus produce voltage variations across the fixed resistor which are proportional to forces exerted by drumstick impacts on the upper surface of the electrode lamination.

Another object of the invention is to provide an impact responsive electronic drumhead that includes a force sensor assembly including a lower FSR lamination, and an upper electrode lamination which has on a lower surface thereof a pair of spaced apart electrode strips arranged in interdigitated circular arc segments.

Another object of the invention is to provide an impact responsive electronic drumhead that includes a force sensor assembly, and an overlying sound-deadening batter pad.

Another object of the invention is to provide an impact responsive electronic head that includes a force sensor assembly, an underlying rigid baseboard, and an overlying batter pad.

Another object of the invention is to provide an impact responsive drumhead what includes a baseboard, an underlying cushion pad, a force sensor assembly supported on the upper surface of the baseboard, and a sound-deadening batter pad overlying the force sensor assembly.

Another object of the invention is to provide a portable drumhead which includes an upper electrode lamination, a lower lamination, and a force sensing resistor (FSR) layer between the upper and lower layers.

Another object of the invention is to provide a portable electronic drumhead which is uniformly responsive to drumstick impacts over its entire upper surface area.

Another object of the invention is to provide a portable electronic drumhead which includes an upper electrode lamination, a lower lamination, a force sensing resistor layer between the upper and lower laminations, and a rigid disk-shaped support base.

Another object of the invention is to provide an electronic drumhead which includes an upper lamination, a lower lamination, a force sensing resistor (FSR) layer between the upper and lower laminations, a rigid disk-shaped support base below the lower lamination and a first resilient cushioning pad which underlies the disk-shaped support base.

Another object of the invention is to provide an electronic drumhead which includes an upper lamination, a lower lamination, a force sensing resistor (FSR) layer between the upper and lower laminations, a rigid disk-shaped support base below the lower lamination and a first resilient cushioning pad which underlies the disk-shaped support base, a second resilient sound deadening batter pad which overlies the upper electrode lamination, and a fabric cover sheet which overlies the batter pad.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of my exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends a portable electronic, percussion type musical instrument, specifically, a portable electronic drumhead. A portable electronic drumhead according to the invention includes a thin, rigid circular disk-shaped base on which is mounted a thinner circular disk-shaped impact sensor assembly. The impact sensor assembly is used to convert impact forces exerted by a drumstick on the upper surface of the assembly to electrical impulses. The electronic drumhead according to the present invention is connectable to and preferably, includes an electronic module which provides a bias voltage to a Force Sensing Resistor (FSR) component of the sensor assembly, which is connected in series with an external fixed bias resistor.

The impact sensor assembly of the portable electronic drumhead according to the present invention has a multi-layer laminated construction which includes a first, lower circular disk-shaped FSR lamination made of a thin, durable polymer such as a polyester film, preferably a PET or MYLAR® film. The upper surface of the first lamination is coated with a relatively thick liquid polymer FSR ink, which cures in response to UV irradiation or solvent evaporation to a solidified electrically conductive coating. The FSR ink contains a very large number of very small electrically conductive particles which are exposed on the upper surface of the FSR coating. and the conductive particles form an electrically conductive path between a pair of closely spaced electrode conductors that contact the ink. Consequently the electrical conductance of which between the electrode conductors is proportional to the force exerted by the conductors on the ink, because a larger number of particles over a larger area are contacted when a greater force is exerted on the FSR coating by the conductors.

The impact sensor assembly also includes a second, upper, circular disk-shaped electrode lamination. The electrode lamination includes a thin, flexible circular substrate made of a durable polymer such as a polyester film, preferably a MYLAR® film. The electrode lamination has on the lower surface thereof, a pair of sensor electrodes conductor strips printed on its lower surface, which faces the FSR coating on the first lamination.

The electrode lamination has the same outline shape as the FSR lamination, and includes a longitudinally elongated, rectangularly-shaped tail section which protrudes radially outwards from the circular disk-shaped section of the lamination. The tail section has printed on its inner, lower surface a pair of radially disposed, straight, parallel spaced apart electrically conductive lead-out conductor strips. Each of the two lead-out conductor strips connect at a radially inwardly located end thereof to a separate one of a pair the sensor electrodes, which have the form of parallel rectangularly-shaped, serpentinely curved conductive electrode strips.

The serpentinely curved sensor electrode conductor strips are arranged in close proximity to one another in an interdigitated pattern, so that when they contact the FSR ink, they form electrically conductive paths between the first conductive sensor electrode strip, an area of FSR ink, and the second conductive sensor electrode strip. In a preferred embodiment, the first and second conductive sensor strips are arranged as a plurality of thin, interdigitated concentric strips of radially spaced apart sectors of a circle.

According to the invention, the impact sensor assembly includes a third, intermediate spacer lamination which is made from a thin sheet of electrically non-conductive material, such as a polyester sheet. The intermediate spacer lamination has the shape of a narrow, flat annular ring which has an outer circumferential edge which is congruent with vertically aligned outer circumferential edges of the upper lamination above the spacer, and the lower, FSR lamination. The spacer lamination also has protruding radially outwardly from radially disposed edges of a narrow slot cut through the ring, radially outwardly, extending tail strips whose outer edges are congruent with the outer edges of the lead-out conductor tail of the overlying upper electrode lamination.

The width of the lead-out strips of the spacer lamination are at least as wide as those of the overlying lead-out conductor strips of the electrode lamination. Thus constructed, when the upper, electrode lamination spacer and lower FSR lamination are brought into intimate contact and secured together by being encapsulated or adhesively adhered to each other, the spacer lamination electrically isolates the conductors on the lower side of the upper, electrode lamination from the electrically conductive FSR layer on the upper surface of the lower, FSR lamination.

However, when any part of the circular disk-shaped area of the upper surface of the upper electrode lamination is subjected to a sufficiently large static pressure, or to the impact force of a drumstick, the flexibility of the electrode lamination substrate enables the inner facing lower surface of the lamination to flex elastically downwards towards the FSR lamination. This downward flexure causes adjacent regions of the serpentine conductive electrode strip pair to be forced into electrically conductive contact with the electrically conductive FSR ink. This electrically conductive contact in turn reduces the electrical resistance between the straight lead-out conductor strips. Therefore, if a bias voltage source is connected in series with an external fixed bias resistor and the lead-out conductor strips of the impact sensor assembly, voltage pulses will be developed across the fixed resistor which are proportional to the magnitude and duration of the increase in conductance of the series circuit consisting of the first sensor lead, the second sensor lead, and FSR material which contacts the interdigitated, curved electrodes, at the location where the first and second laminations are urged more closely together by the impact of a drumstick.

According to the invention, the fixed external bias resistor has a lower, ground lead and an upper, signal lead which are connected to the input port of an electronic signal processing module. The signal processing module amplifies and electronically processes voltage pulses produced across the fixed resistor in response to drumstick impacts on the sensor assembly. The amplified and processing signals are output on an output port of the signal processing module, where earphones or other such transducer converts the signals to sounds which simulate such drumbeats.

DESCRIPTION OF THE PREFERRED EMBODIMENTS

Figure 1:
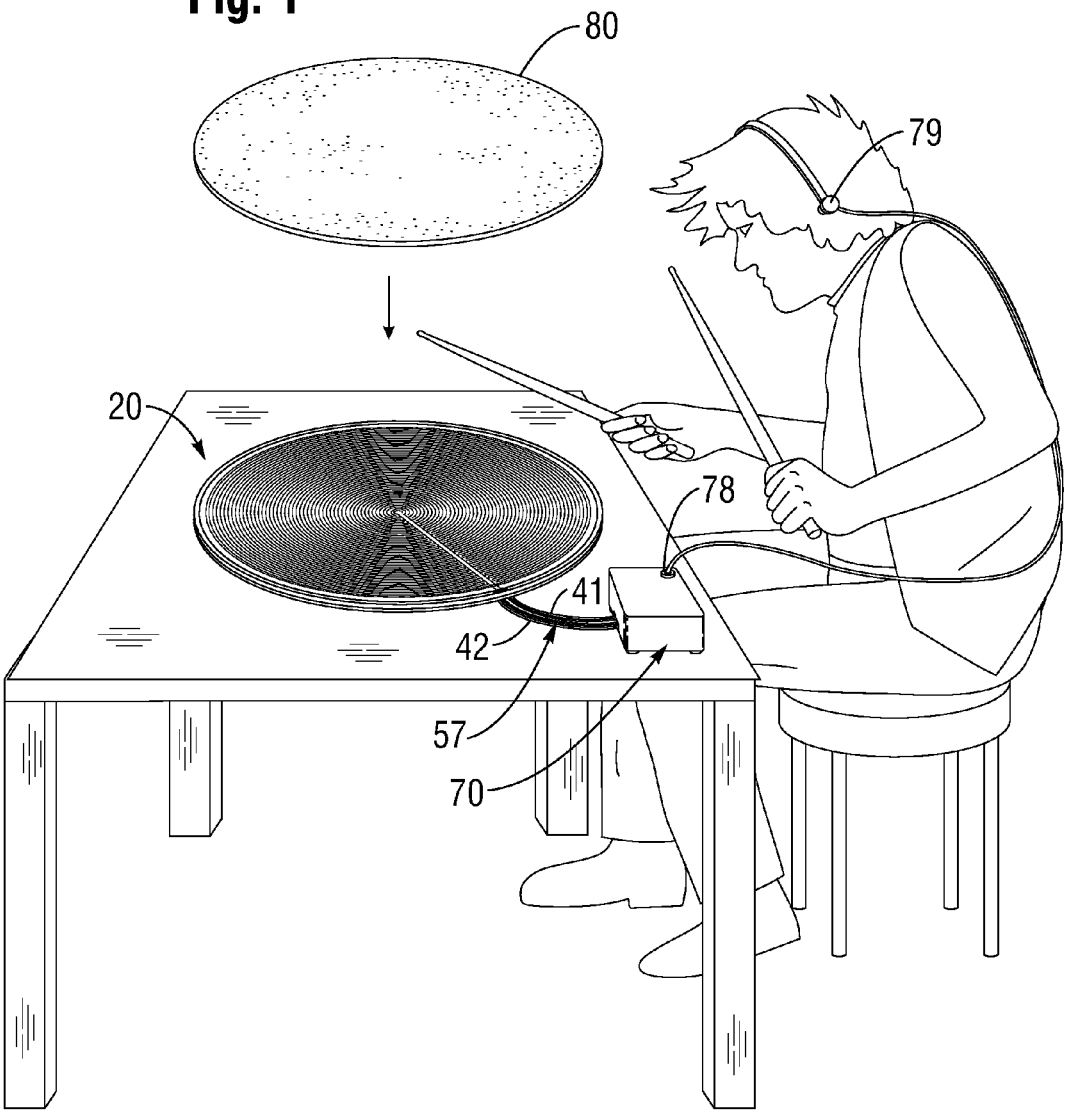
FIG. 1 is a perspective view showing a portable electronic drumhead according to the present invention in use.

FIGS. 1-10 illustrate a portable electronic drumhead according to the present invention. FIGS. 11-26 illustrate modifications of the drumhead shown in FIGS. 1-10.

Referring first to FIGS. 1, 3, 8 and 9, it may be seen that a portable electronic drumhead 20 according to the present invention includes a relatively thick circular disk-shaped baseboard 21 which has flat, parallel upper and lower surfaces 22, 23. Baseboard 21 is made of a relatively hard, rigid material such as polypropylene or Masonite and serves as a substrate or support for a relatively thinner circular disk-shaped sensor assembly 24 which is mounted on the upper surface 22 of the baseboard 21 and secured thereto by suitable means, such as an adhesive bond 25.

Figure 3:
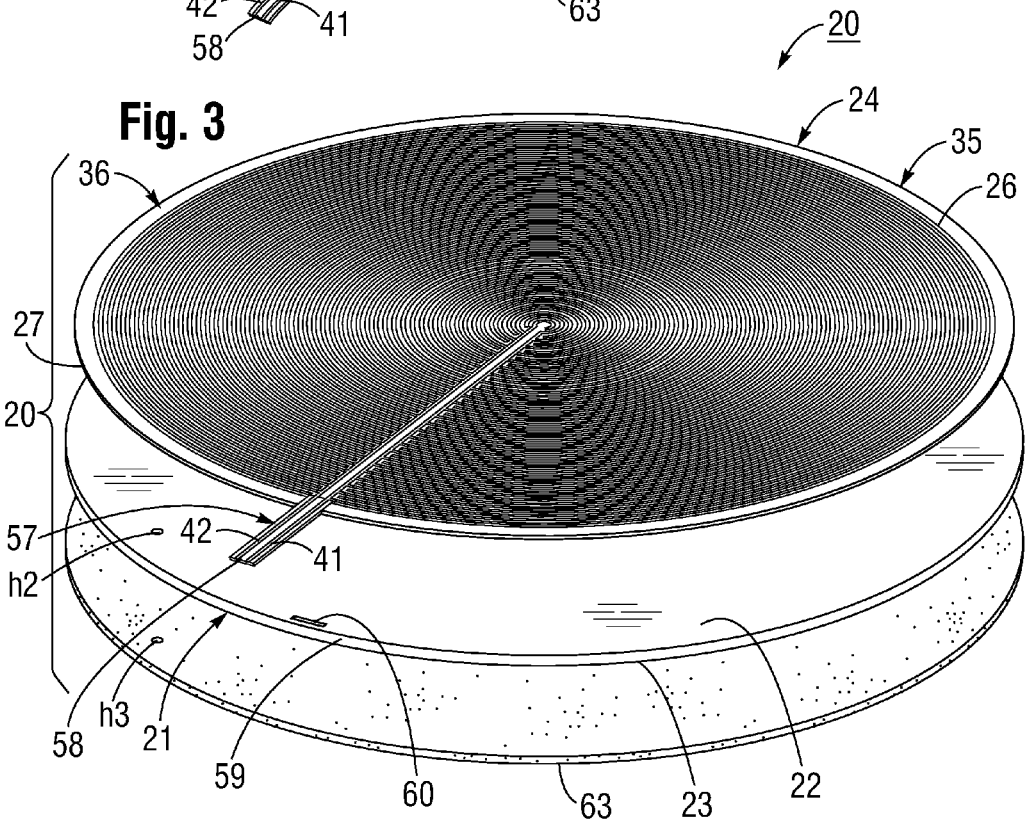
FIG. 3 is an exploded view of the drumhead of FIGS. 1 and 2.
Figure 7:
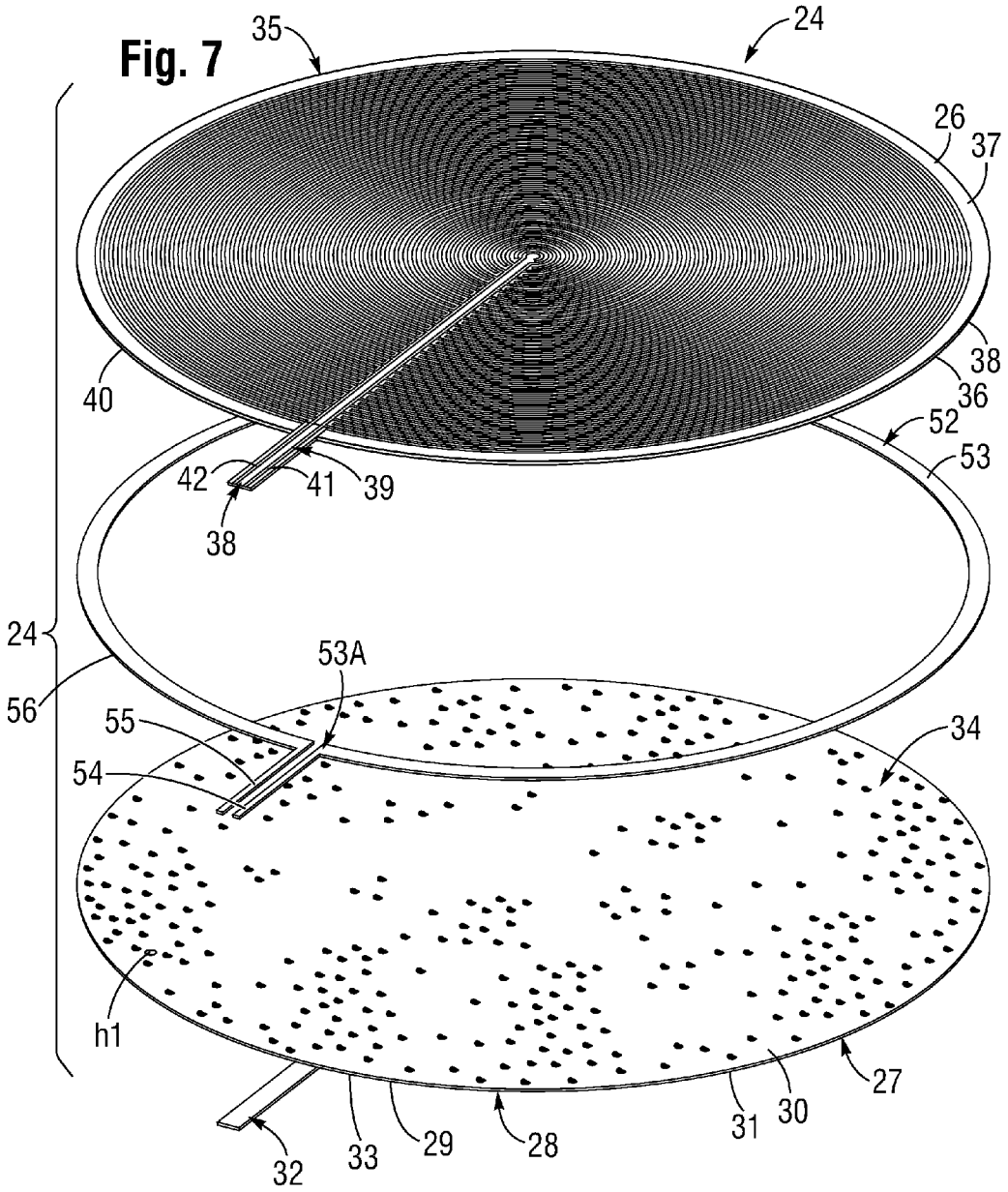
FIG. 7 is a fragmentary exploded view of the drumhead of FIGS. 1 and 2, showing details of a sensor assembly part thereof.

As shown in FIGS. 3 and 7, impact sensor assembly 24 has a laminated construction which includes a stack of thin, flat circular laminations which are bonded together to form a thin, flat circular body which has flat and parallel upper and lower surfaces 26, 27.

As may be seen best by referring to FIG. 7, impact sensor assembly 24 includes a first, lower conductive FSR film lamination 28 which is made of a thin, flexible substrate sheet 29 composed of a durable, electrically non-conductive material, such as a polyester film, of the type marketed under the trade name MYLAR®. In an example embodiment, substrate sheet 29 had a thickness of 0.007 inch.

The substrate sheet 29 of lower lamination 28 has flat and parallel upper and lower surfaces 30, 31, a circular shape, and has a radially elongated rectangularly bar-shaped tail section 32 which protrudes radially outwards of the outer circumferential edge 33 of the lower substrate sheet. As shown in FIG. 7, substantially the entire circular part of the upper surface 30 of substrate sheet 29 is uniformly covered with a relatively thick coating 34 of a polymer Force Sensing Resistor (FSR) ink. The FSR ink has an electrical conductivity which increases in proportion to a force exerted on the FSR ink coating by electrical conductors. In an example embodiment of electronic drumhead 20, coating 34 consisted of s screen printed layer of a carbon based electrically conductive force sensing ink obtained from Sensitronics Corporation, 16120 Park Place, Bow. Wash. 98232. Optionally, the FSR material may be within a plastic matrix or a Force Transducing Rubber (FTR) obtainable from Sensitronics.

Referring still to FIG. 7, it may be seen that sensor assembly 24 of portable electronic drumhead 20 includes a second, upper, active area or electrode lamination 35. Electrode lamination 35 has a thin, flexible substrate sheet 36 which is similar in size, shape, thickness and composition to the polyester substrate sheet 29 of FSR conductive film lamination 28, and thus has flat, parallel upper and lower surfaces 37, 38, and a rectangular bar-shaped tail section 39 which protrudes radially outwards of the outer circumferential edge 40 of the substrate sheet.

In the example embodiment of sensor assembly 24 shown in FIGS. 1-7, substrate sheet 36 of electrode lamination 35 was made of a transparent MYLAR®. film, thus making the conductors printed on the lower surface 38 of the substrate sheet clearly visible when the substrate sheet is viewed from above upper surface 37 of the substrate sheet.

As shown in FIGS. 3 and 7, substrate sheet 36 of upper, electrode lamination substrate 35, has adhered to the lower planar surface of the tail section 39 of the substrate sheet a pair of radially disposed, straight, longitudinally elongated, parallel, laterally spaced apart rectangular lead-out conductor strips 41, 42.

Figure 4:
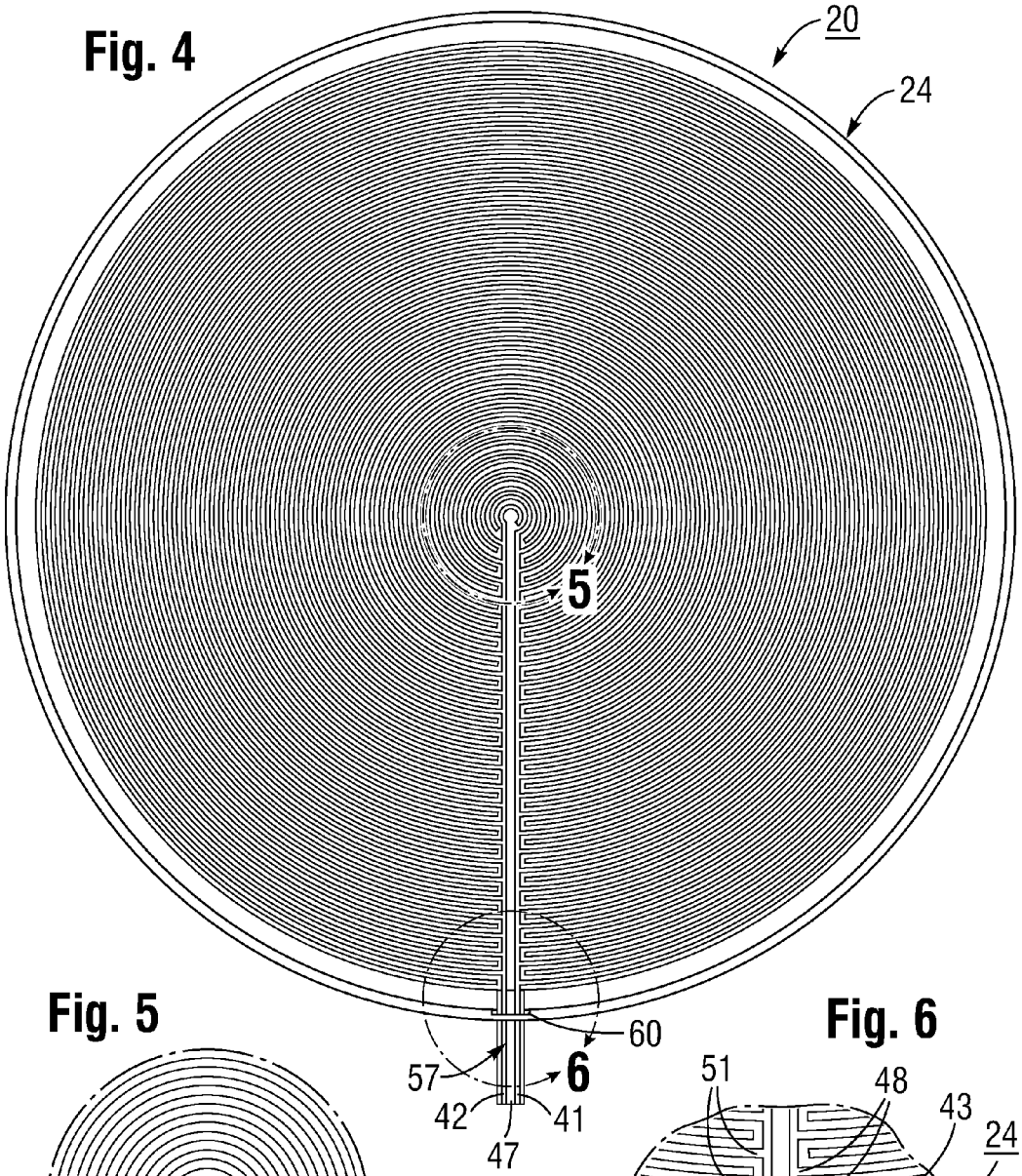
FIG. 4 is an upper plan view of the drumhead of FIGS. 1 and 2, on an enlarged scale.
Figure 5:
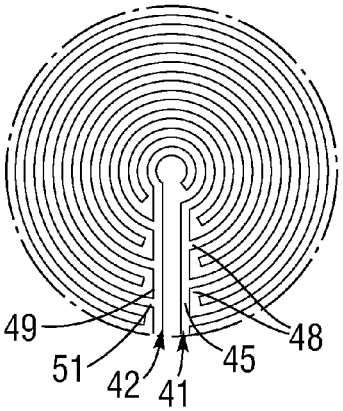
FIG. 5 is a fragmentary view of a central part of the drumhead of FIG. 4, taken in the direction 5-5.
Figure 6:
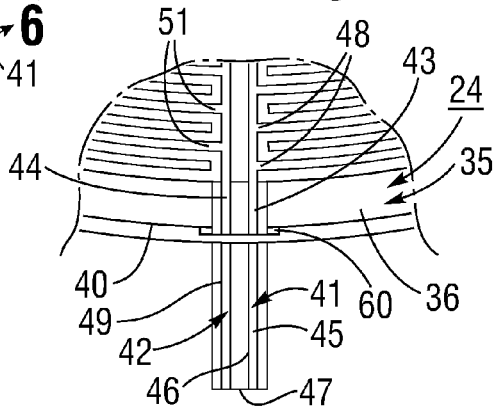
FIG. 6 is a fragmentary view of a peripheral part of the drumhead of FIG. 4, taken in the direction 6-6.

As may be seen best by referring to FIGS. 4-6, each straight lead-out strip 41, 42 is connected at an inner radial end thereof, inward of the outer circumferential edge 40 of lamination substrate 36, to a pair of spaced apart, uniform width rectangular conductive strips 43, 44 which are spaced equidistant from one another. The lead-out conductor strips 41, 42 extend radially inwards of the outer, circumferential edge 40 of lamination substrate sheet 36, nearly to the center of the sheet. Thus, for example, lead-out strip 41 has the shape of a longitudinally elongated rectangular strip which has parallel outer and inner radially disposed edges 45, 46. The strip extends radially inwards from the outer transverse edge 47 of lead-out tail section 39 along a radius of the circular disk-shaped substrate sheet 36, nearly to the center of the sheet.

As shown in FIGS. 4-6, the outer radially disposed edge 45 of that part of lead-out strip 41 which is located on the circular part of substrate sheet 36 radially inwards of outer circumferential edge 40 of the substrate sheet has protruding perpendicularly outwards therefrom a concentric row of radially spaced apart, uniform width, rectangular electrically conductive strips which function as electrodes 48. Electrode strips 48 are thin, electronically conductive elements which are fixed to the lower surface 38 of electrode lamination 35, preferably by screen printing.

Electrode strips 48 are curved in the shape of concentric circular sectors. Each of the circular sector-shaped electrode strips 48 which extend outwards from the outer radial edge 45 of strip 41 has at a distal end thereof a radially disposed edge which lies on a radius of the disk which is spaced circumferentially apart from the outer radially disposed edge 49 of lead-out strip 42.

As shown in FIGS. 4-6, lead-out strip 42 also has extending perpendicularly outwards from its outer radial edge 49 a series of concentrically arranged, uniform width conductive electrode strips 51. The conductor strips 51 are arranged identically with, and spaced apart uniformly in an interdigitated arrangement with the circular sector-shaped conductive electrode strips 48 that extend from lead-out strip 41, and also preferably are printed circuit conductors on the lower surface of electrode lamination 35.

The interdigitated, concentric, uniform width and uniform parallel spacing sensor conductive electrode strips 48, 51 are spaced closely together, so that when they contact the FSR coating 34 on lower lamination 28, the FSR coating forms electrically conductive paths between the strips. In a example embodiment of drumhead 20, the lead-out conductor strips 41,42 and electrode strips 48,51 consisted of printed circuit traces formed on the inner planar surface of substrate sheet 36 of electrode lamination 35.

According to the invention, sensor assembly 24 includes a third, electrically non-conductive spacer lamination 52, which is preferably made from a thin polyester sheet. As shown in FIG. 7, spacer lamination 52 has generally the shape of flat, narrow uniform width annular ring-shaped sector 53 which has an outer circumference of the same size as those of lower lamination 28 and upper lamination 35.

As shown in FIG. 7, the annular ring sector 53 does not make a complete circle, but terminates at circumferentially spaced apart, radially disposed edges of a narrow slot 53A disposed radially through lamination 52 by a pair of spaced apart tail sections 54, 55 which protrude radially outwards from the outer circumferential edge 56 of lamination 52.

The tail sections 54, 55 have the same length as radially disposed lead-out conductors 41 and 42 of upper, electrode lamination 35, and are vertically aligned with the lead-out conductors, but preferably somewhat wider. Thus constructed, when the lower FSR layer lamination 28, intermediate spacer lamination 52 and upper electrode lamination 35 are vertically aligned, brought into parallel contact and secured together by being encapsulated or adhesively adhered together, the spacer lamination electrically isolates the lead-out conductors on the lower side of the tail section of the active area lamination from electrically conductively contacting the FSR coating, and also serves to space the concentric conductors away from the FSR coating. However, when any part of the circular disk-shaped area of the surface of the upper electrode lamination 35 is forced downwards towards the lower FSR lamination 28 with a sufficiently large force or pressure, for example, as a result of being impacted by a drumstick, the flexibility of the electrode lamination and the FSR lamination, adjacent parts of the concentric electrode pairs are forced into electrically conductive contact with the FSR coating, thus decreasing the electrical resistance between the conductors. As will be explained in further detail below, this reduction in electrical resistance is used to produce electronic simulations of drum beat sounds in response to drumstick impacts on any part of the upper surface of sensor assembly 24.

In a preferred embodiment, the size, thickness and composition of substrate sheet 29 of lower FSR lamination 28 and substrate sheet 36 of upper electrode lamination 35 are the same. With this construction, sensor assembly 24 may be optionally flipped over and the now upwardly facing outer surface 27 of FSR lamination 28 struck with drumsticks to produce electronic simulations of drum beat sounds in response to drumstick impacts of any part of the outer surface of the FSR lamination.

Preferably, sensor assembly 24 includes in addition to spacer lamination 52, additional elements to bias apart the electrically conductive confronting surfaces of the FSR coating 34 and electrode conductors 42 and 44. Thus, a plurality of dielectric dots are adhered to the lower surfaces of the conductors 42, 44 on the lower surface 38 of substrate sheet 36 of electrode lamination 35. In an example embodiment, the dielectric dots were made of ultraviolet (UV)-cured ink, had a diameter in the approximate range of about 6.35 mm to about 9 mm, a thickness of about 0.038 mm to about 0.076 mm and were distributed uniformly over lower surfaces of substrate sheet 36 at a density of about 8 dots per square cm.

As shown in FIG. 7, FSR lamination substrate sheet 29 has through is thickness dimension an air bleed hole h1 located near the outer circumferential edge of the substrate sheet. Air bleed hole h1 permits air compressed between the FSR lamination and the electrode lamination when the laminations are flexed towards one another in response to a drumstick impact to be expelled, and permits air to enter the space between the laminations when the compressive flexural force on the laminations is relieved in response to withdrawal of the drumstick away from the drumhead.

As shown in FIGS. 2, 3, 6, 7 and 9, the tail section 39 of upper, electrode lamination 35, intermediate insulating tail sections 54, 55 of insulating spacer lamination 52, and tail section 32 of lower, FSR lamination 28, are sandwiched and adhesively bonded together to form a laminated interface tail 57. As shown in FIG. 6, lead-out conductor strips 41, 42 extend radially outwards of the outer transverse edge 58 of interface tail 57, so that electrical contact may be made to the lead-out conductor strips.

Figure 2:
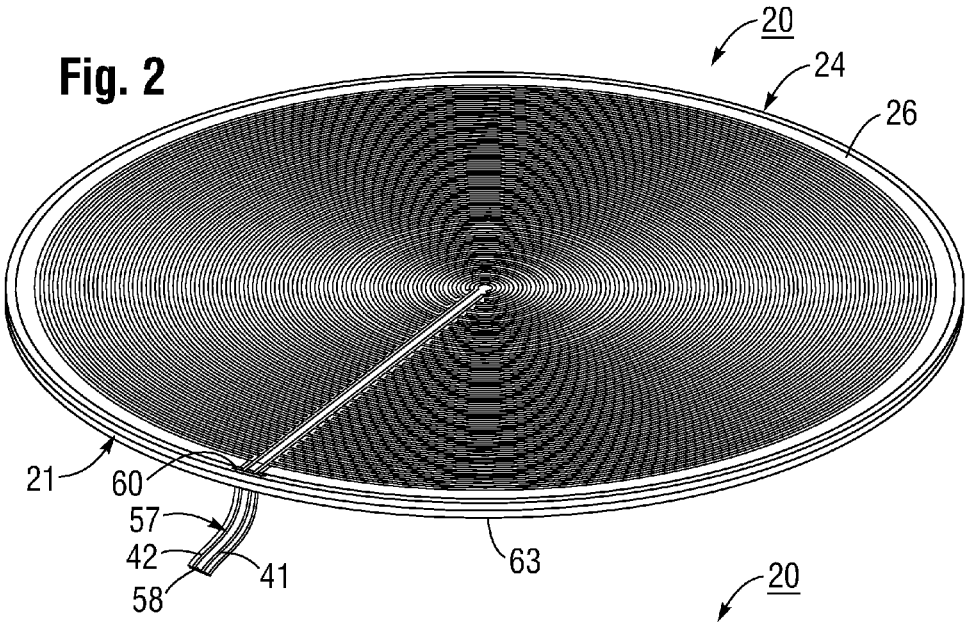
FIG. 2 is an upper perspective view of the portable electronic drumhead of FIG. 1.
Figure 9:
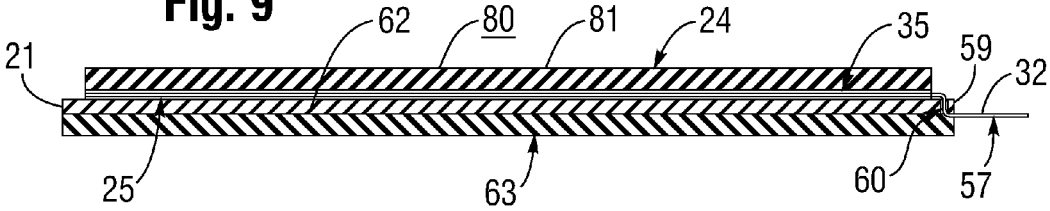
FIG. 9 is a vertical longitudinal sectional view of the drumhead of FIG. 8, taken in the direction 9-9.

As shown in FIGS. 2, 3 and 9, baseboard 21 has located a short distance radially inwards of its outer circumferential edge 59 a short circular arc-shaped slot 60. Slot 60 is concentric with circular electrode lamination 35 and baseboard 21, and has an arc length slightly longer than the width of lead-out strip 39 which extends radially outwards from electrode laminations 35 and interface tail 57 shown in FIGS. 1, 2 and 9. This construction enables the interface tail 57 to be threaded downwards through slot 60, and radially outwards between the lower surface 61 of baseboard 21 and the upper surface 62 of a flat circular disk-shaped base pad 63. Base pad 63 is made of a sound absorbing material such as rubber, and has an upper flat surface 64 which is adhesively bonded to the lower surface 61 of baseboard 21. In an example embodiment, base pad 63 was made of a sponge rubber and had a thickness of about ⅛th inch. As shown in FIGS. 3 and 7, baseboard 21 is provided with an air bleed hole h2, and base 63 is provided with an air bleed hole h3, both of which are vertically aligned with sensor assembly air bleed hole h1.

Figure 10:
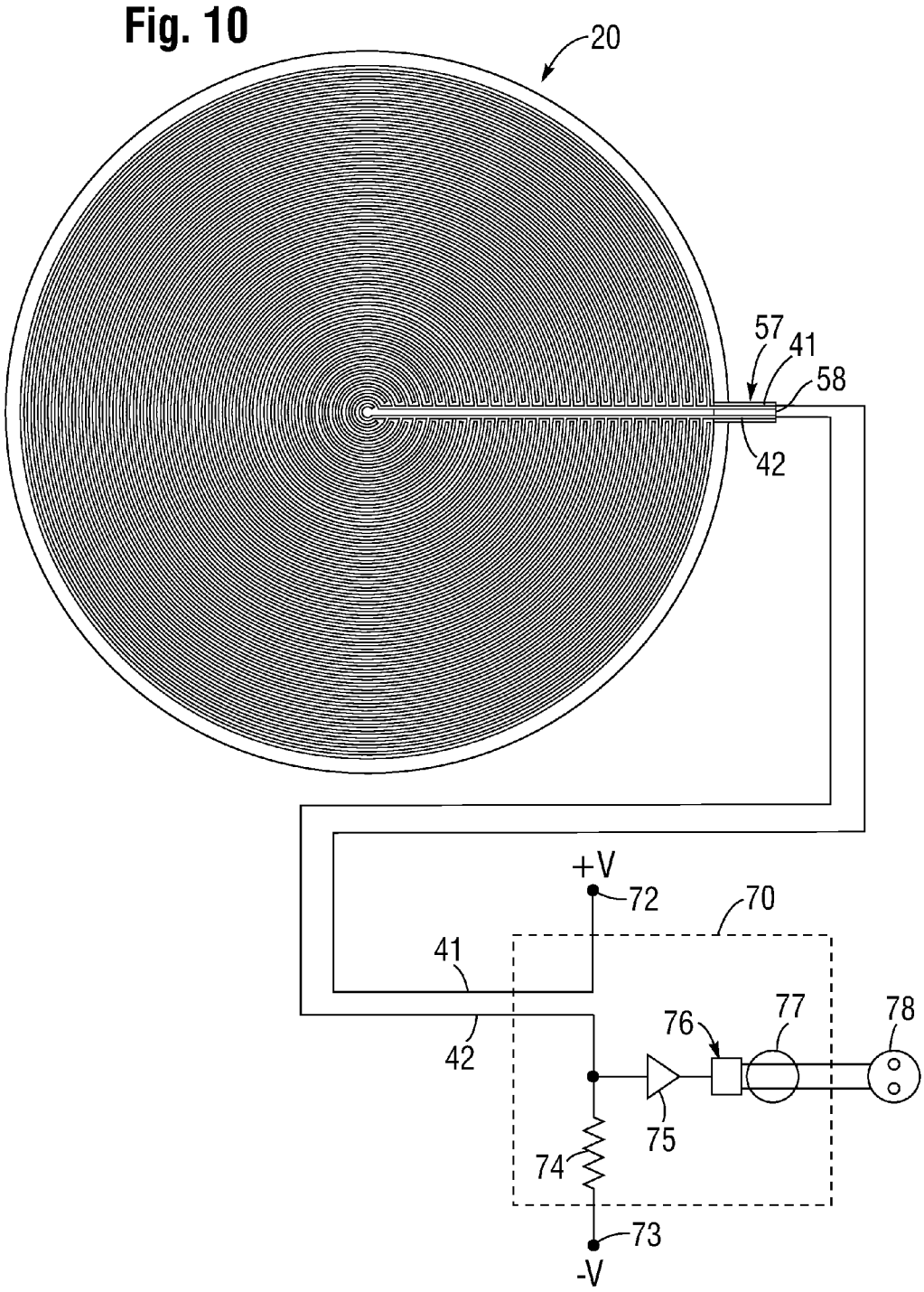
FIG. 10 is a partly diagrammatic view showing the drumhead of FIG. 1, and an electronic signal processing module thereof.
Figure 11:
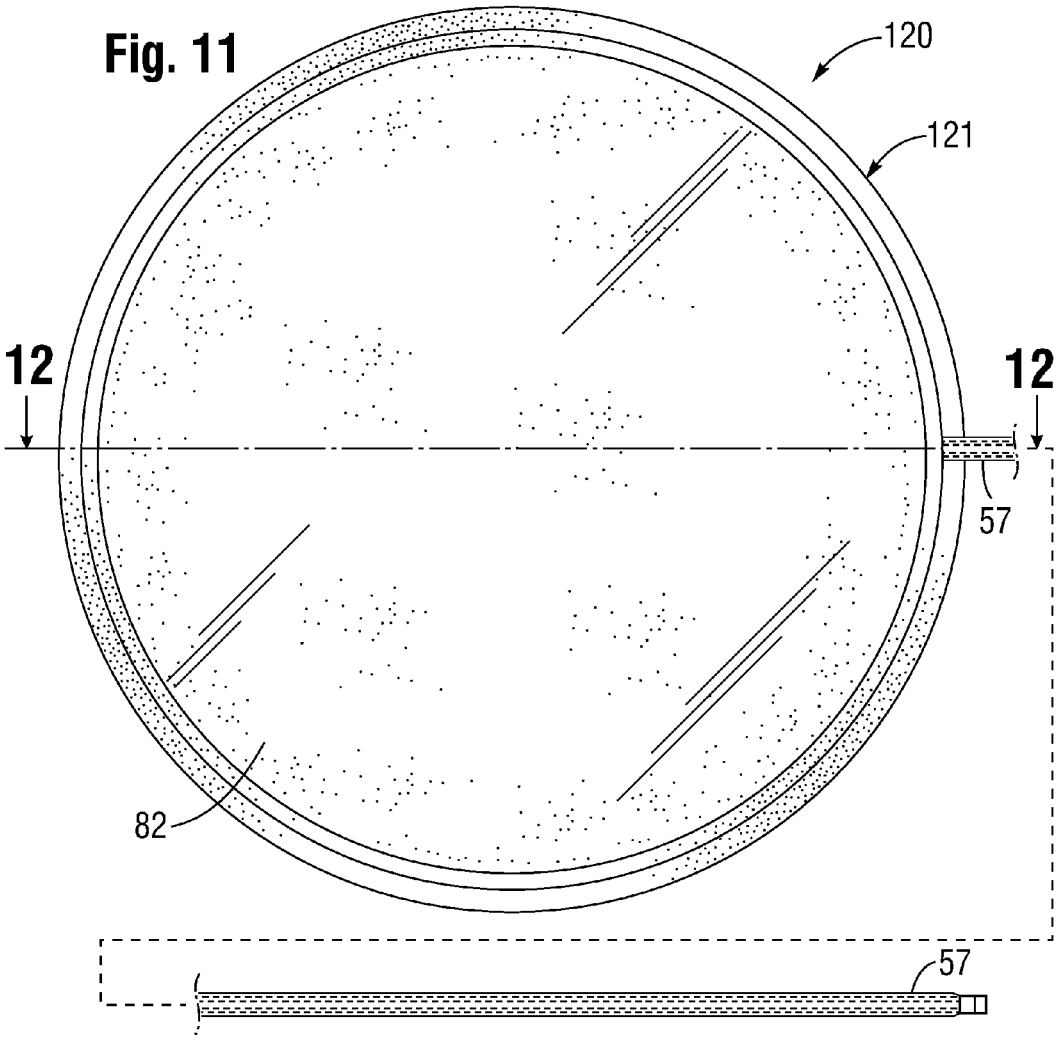
FIG. 11, is an upper plan view of a first modification of the drumhead of FIGS. 1-10.

As shown in FIGS. 1 and 10, impact responsive electronic drumhead 20 includes an electronic interface module 70 which converts increases in electrical conductivity between lead-out conductor strips 41, 42 resulting from drumstick impacts on sensor assembly 24, into voltage pulses. Thus, as shown in FIG. 10, electronic interface module 70 includes a bias voltage source 71 which has one terminal 72 thereof connected to one lead-out strip conductor, e.g., lead-out strip conductor 41. The other terminal 73 of the bias voltage source 72 is connected through a load resistor 74 to the other lead-out terminal. With this arrangement, conductivity increases of sensor assembly 24 resulting from drumstick impacts cause corresponding positive-going voltage pulses to occur at lead-out conductor strip 42. The voltage pulses are input to an amplifier 75 and signal processing circuitry 76 in interface module 70.

Preferably, signal processing circuitry 76 includes an analog or digital sound synthesizer which converts voltage pulses resulting from drumstick impulses on sensor assembly 24 into audio frequency signals which may be adjustable in fundamental frequency. Optionally, timbre, attack, reverberation time and other musical sound parameters may be varied by adjusting the transfer function of signal processing circuitry 76, in a manner well known to those skilled in the art of electronic music synthesizers.

An external output port 78, such as an earphone or loudspeaker jack, of electronic module 70 is connected to the output port 77 of signal processing circuitry 76. External output port 78 is connectable to a loudspeaker or earphones 79 as shown in FIG. 1, thus converting electrical signals output from signal processing circuitry 76 into audible sounds which may simulate sounds produced by striking an acoustic drum.

Figure 8:
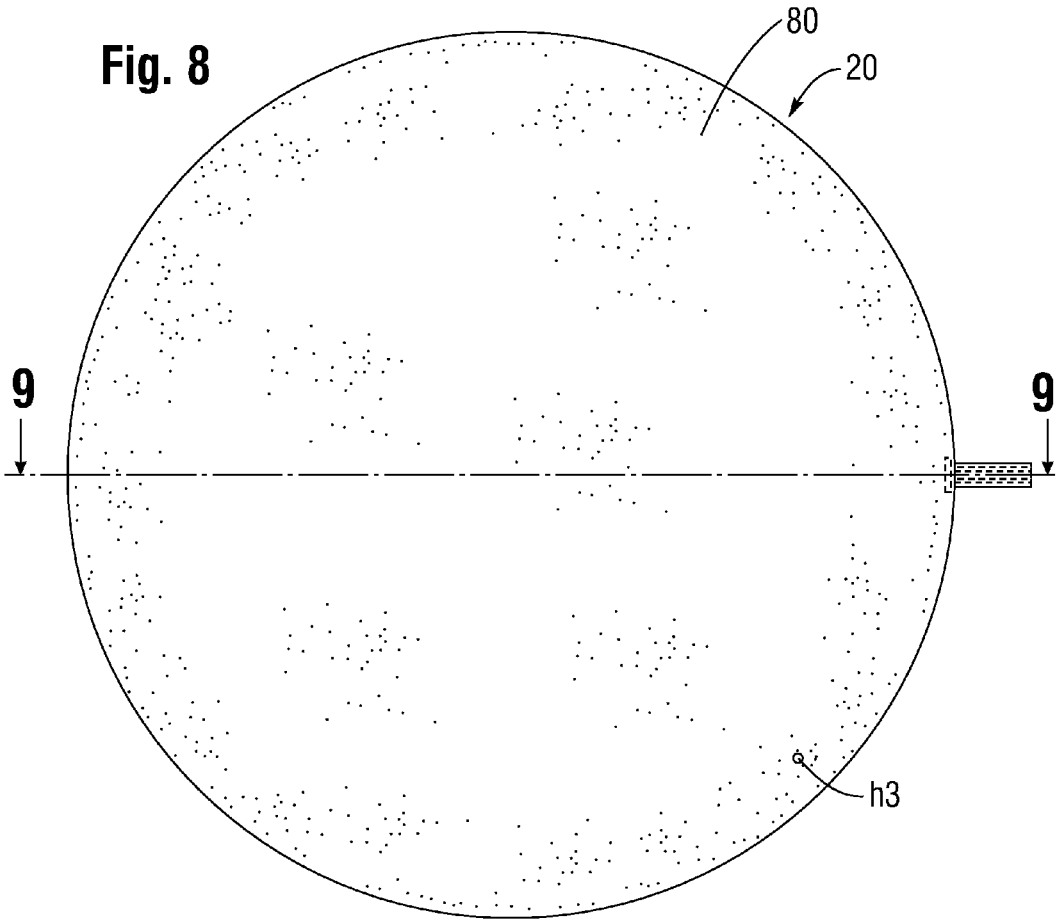
FIG. 8 is a lower plan view of the drumhead of FIGS. 1 and 2.

Preferably, as shown in FIGS. 1, 8 and 9, the impact responsive electronic drum 20 includes a sound deadening batter pad 80, which is preferably made of rubber and placed on the upper, striking surface of electrode lamination 35 of sensor assembly 24. According to the invention, batter pad 80 is sufficiently resilient as to produce minimally audible impact sounds when impacted by a drumstick. However, because the sensor assembly 24 is uniformly and highly responsive to impact forces over its entire upper surface area, electronic drum 20 produces easily amplifiable signals that respond to light, nearly inaudible impacts of a drumstick on the upper surface of the batter pad 80. Thus, the novel design and construction of electronic drumhead 20 enables a musician to hone his or her drum playing skills in which realistic percussion drumhead sounds are heard in earphones 79 while the sounds produced by drumstick impacts on batter pad 80 are barely audible to persons nearby. In an example embodiment, batter pad 80 was made of ½ inch thick natural rubber.

As shown in FIG. 7, electrode lamination 35 of impact sensor assembly 24 is positioned above FSR lamination 28, thus positioning outer surface 37 of the electrode lamination for receiving drumstick impacts. Optionally, by making the substrate sheet 29 of FSR lamination 28 of the same composition material having the same thickness and area as that of substrate sheet 36 of electrode lamination 35, the responsivity of the impact sensor assembly in producing electrical resistance changes resulting from drumstick impacts on outer surface 26 of the FSR lamination sheet can be made substantially similar to that of drumstick impacts on the outer surface 37 of electrode lamination 35. In this case, sensor assembly 24 may optionally be inverted from the orientation shown in FIG. 9, thus portioning FSR lamination 28 above electrode 35.

FIGS. 11-16 illustrate a first modification 120 of electronic drumhead 20, in which batter pad 80 has fixed to upper surface 81 thereof a protective overlay sheet 82 to minimize impact pitting of the upper surface of the batter pad in response to repeated drumstick impacts. In an example embodiment of drumhead 20, overlay sheet 82 was made of circular disc shaped sheet of 0.005 inch thick acrylic fabric coated with a pressure sensitive acrylic adhesive which was used to adhere the overlay sheet to the upper surface 81 of batter pad 80. The aforementioned acrylic fabric is obtainable as Flexmark® PC 600V-156 90 PFW from Flexcon company, Industrial Park, Spencer Mass. 01562.

Figure 12:
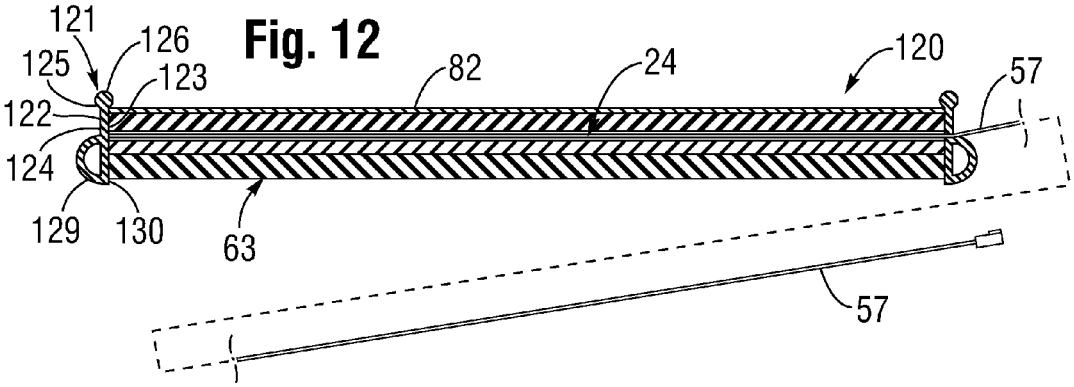
FIG. 12 is a vertical longitudinal sectional view of the drumhead of FIG. 11, taken in the direction 11-11.
Figure 13:
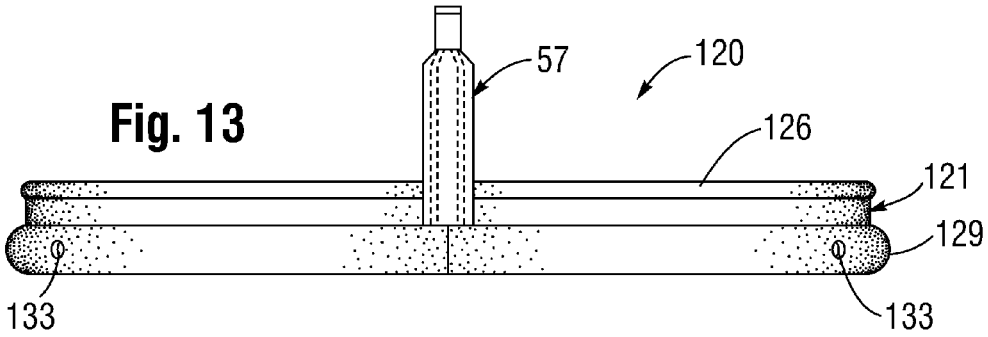
FIG. 13 is a right-side elevation view of the drumhead of FIG. 11.
Figure 14:
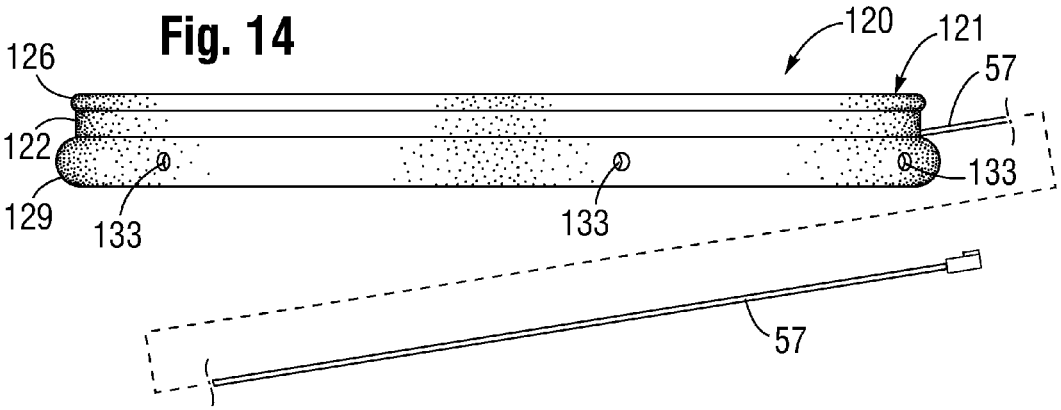
FIG. 14 is a front elevation view of the drumhead of FIG. 11.

As is shown in FIGS. 11-16, modified drumhead 120 includes a retainer ring 121 which girdles the outer circumferential of the vertical stack of laminations of the drumhead shown in FIG. 9, including base pad 63, baseboard 21, sensor assembly 24 batter pad 80, and batter pad overlay sheet 81, as shown in FIG. 14.

As is also shown in FIGS. 11-16, retainer ring 121 has generally the shape of a circular ring-shaped band that has a vertically disposed flat band section 122 that has parallel vertical inner and outer circumferential wall surfaces 123, 124. Flat band section 122 of retainer ring 121 has protruding upwardly from an upper horizontally oriented annular end wall 125 thereof a circular ring shaped flange 126, similar to the lip-like bead on the inner circumferential edge of a pneumatic tire, which has an approximately circular transverse cross section. As shown in the figures, the outer circumferential edge of bead ring flange 126 extends radially outwards of outer wall surface 124 of flat band section 122 of retainer ring 121. Also, the inner circumferential edge of flange 126 extends radially inwardly of inner wall surface 123 of flat band section 122 of retainer ring 121, thus overlying an outer circumferential edge portion of upper surface 127 of overlay sheet 82.

Flat band section 122 of retainer ring 121 also has protruding downwardly from a lower horizontally oriented annular end wall 128 thereof a circular ring shaped tubular bead flange 129. Tubular bead flange 129 has generally a semicircular transverse cross section of larger diameter than that of the upper circular cross section sold bead ring flange 126. As shown in FIG. 14, the lower edge wall of tubular bead ring flange 129 has a radially inwardly extending, circular ring-shaped lip 130. Lip 130 underlies an outer circumferential edge portion of base pad 63. Lower tubular bead ring flange 129 also has an outer curved surface which extends radially outwards of outer surface 124 of flat band section 122 of retainer ring 121.

Figure 15:
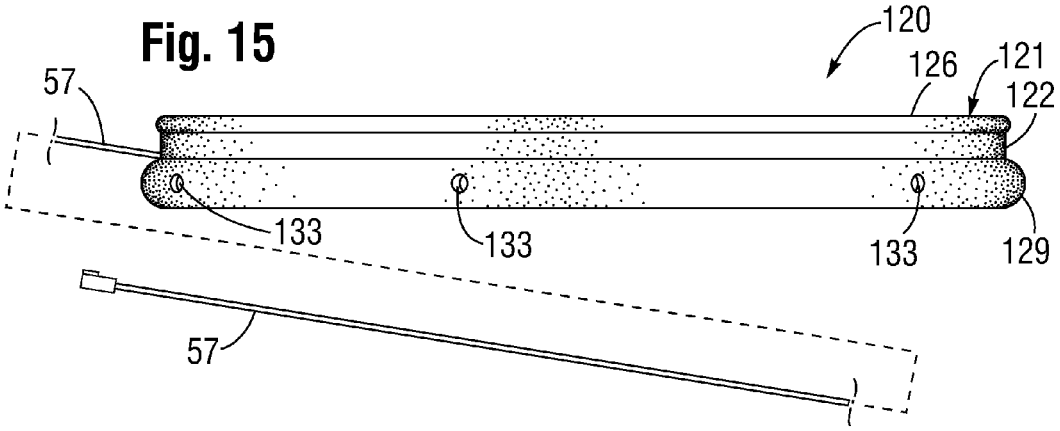
FIG. 15 is a rear elevation view of the drumhead of FIG. 11.
Figure 16:
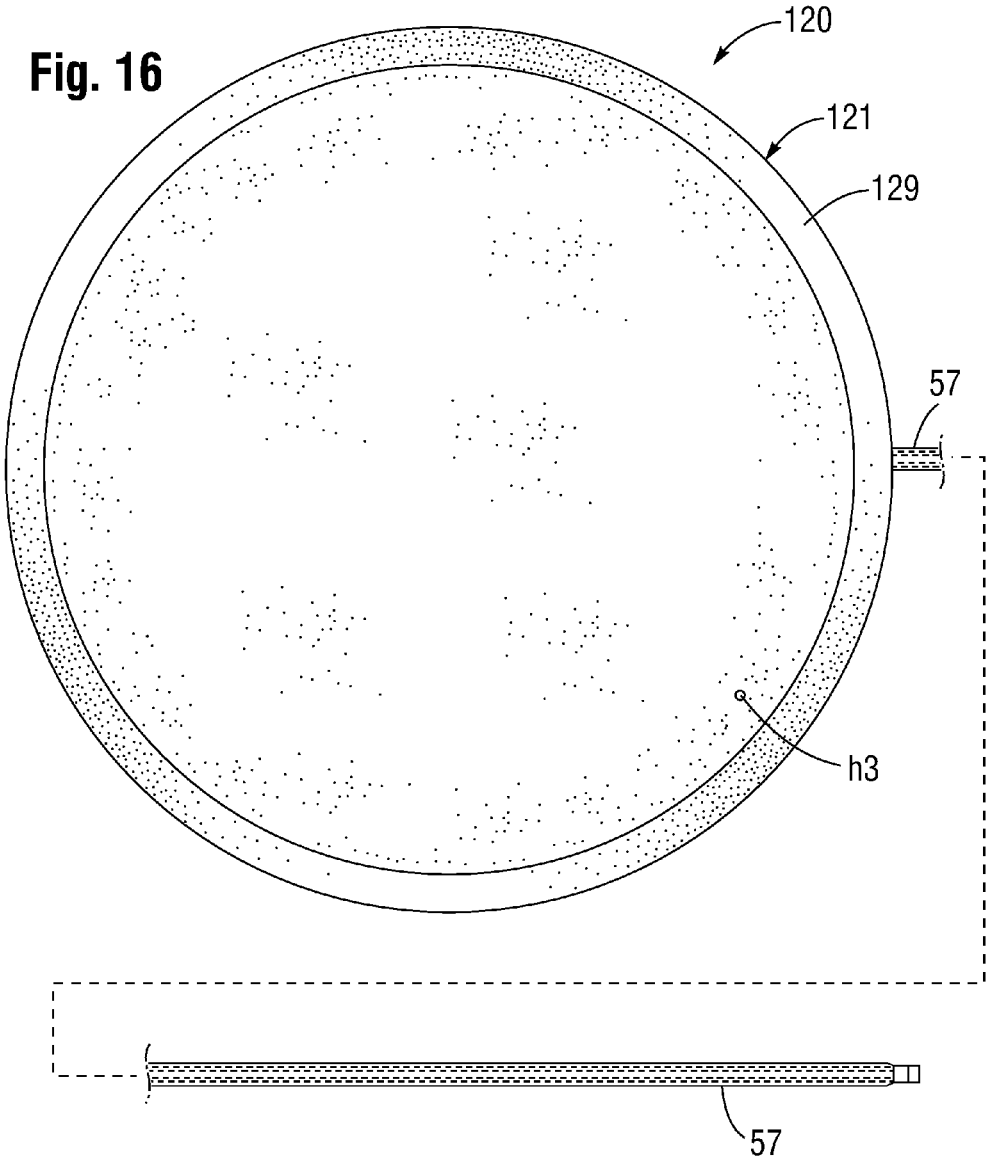
FIG. 16 is lower plan view of the drumhead of FIG. 11.

As may be seen best by referring to FIG. 12, retainer ring 121 has a uniform transverse cross-sectional shape. In a preferred embodiment, retainer ring 121 is made from an elongated rubber extrusion which is cut to a length equal to the outer circumference of sensor assembly 24. The cut length is then bent into a circular shape around the circumference of the sensor assembly, and secured thereto by adhesive bonding. As shown in FIGS. 13-15, a series of circumferentially spaced apart circular holes 133 are made through the outer wall surface 132 of tubular bead flange 129. Holes 133 are provided to enable outer wall surface to stretch when the straight extrusion from which retainer ring 121 is made is bent into a circle. Thus, as shown in the figures, circular holes 133 are deformed into circumferentially elongated oval shapes in finished retainer ring 121.

In a preferred embodiment, retainer ring 121 is made of a relatively soft rubber, such as Santoprene thermoplastic elastomer manufactured by Exxon-Mobil and having a durometer hardness of 35 With this construction, modified electronic drumhead 120 is useable on a table top as is the basic embodiment 20 described above. Modified electronic drumhead 120 may also be placed on the drumhead of an acoustic drumhead and used for practice by a drummer. The structure and composition of the soft rubber retainer ring 121 facilitates maintaining electronic drumhead 120 in a fixed position on a drumhead of an acoustic drum as the drumhead 120 receives impacts from drumsticks.

Figures 17A, 17C, 17D:
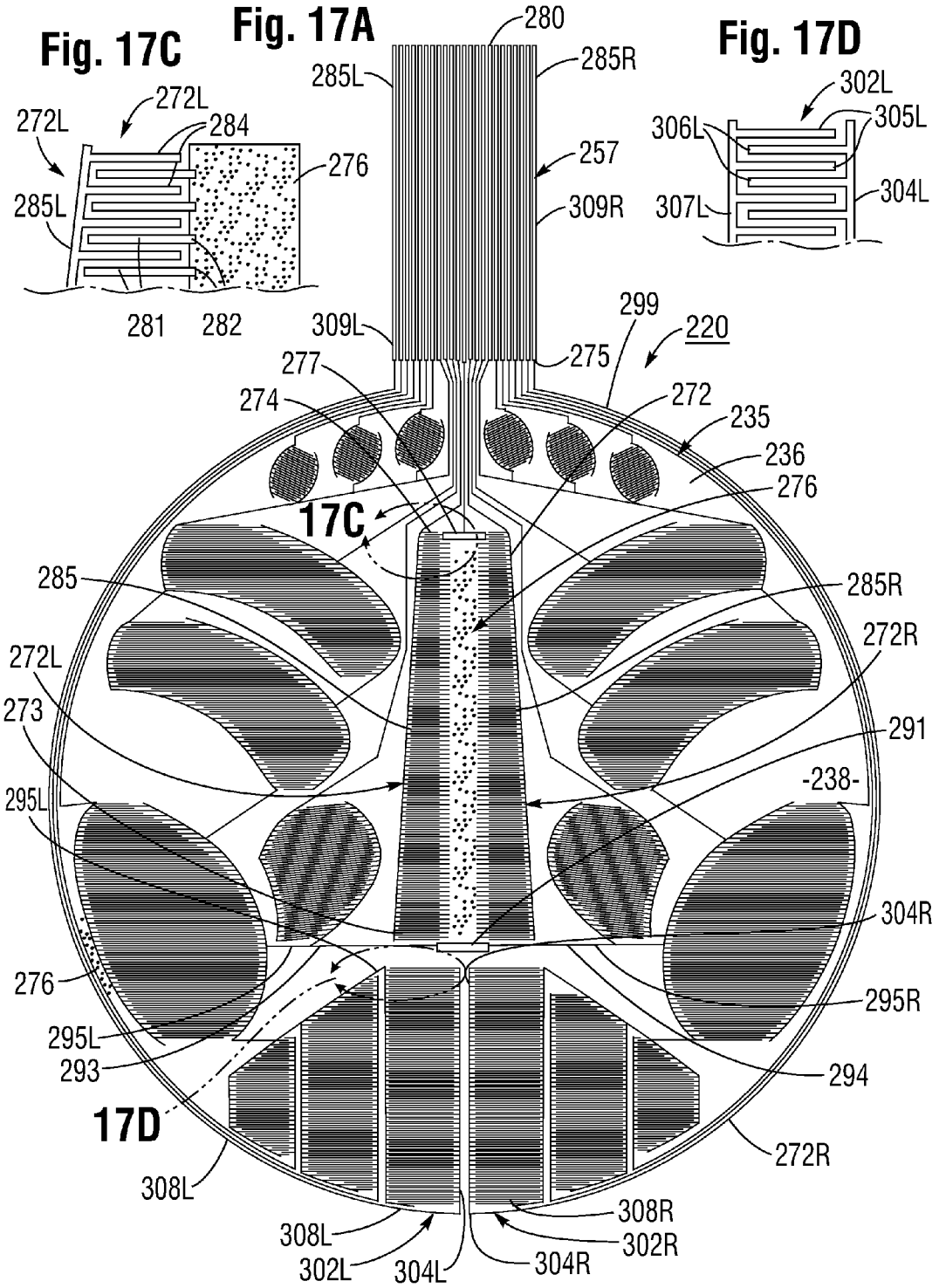
FIG. 17A is a lower plan view of an electrode lamination for a multi-zone hand drum modification of the drumhead shown in FIG. 1.
FIG. 17C is a fragmentary view of the electrode lamination on a further enlarged scale, showing a part of a central force and position sensor thereof.
FIG. 17D is a fragmentary view of the electrode lamination of FIG. 17A on a further enlarged scale, showing part of a peripheral force sensor thereof.

FIG. 17A is a lower plan view of a electrode lamination 235 for a multi-zone electric drumhead 220 which is a modification of drumhead 20 that is suited to being impacted by a person's hands rather than drumsticks. Drumhead 220 has distributed over its surface multiple spaced apart impact sensor assemblies 271, 272 which replace the single sensor assembly 24 used in the basic embodiment 20 described above.

As shown in FIG. 17A, electrode lamination 235 includes a thin, flexible circular disk-shaped substrate sheet 236 which is substantially similar in construction and function to the substrate sheet 36 of electrode lamination 35 of drumhead 20 shown in FIGS. 1-10 and described above. Thus, electrode lamination 236 has affixed to lower surface 238 thereof multiple groups of silver printed circuit traces in the form of thin, straight uniform width strips. The traces are arranged in interdigitated patterns to form multiple individually spaced apart peripheral sensors 271 which are distributed at different locations or zones over the lower surface 238 of the electrode lamination, as shown in FIGS. 17A, 17B and 17C, spaced apart from a centrally located impact sensor 272.

The exact number, shape and location of the zone sensors 271 is to a certain extent a matter of design choice. However, the sensors 271 preferably occupy a substantial percentage of the surface area of the electrode lamination 236, so that there will be a minimum total area of dead zones, where the drumhead 220 is unresponsive to input of fingers or hands.

Figure 17B:
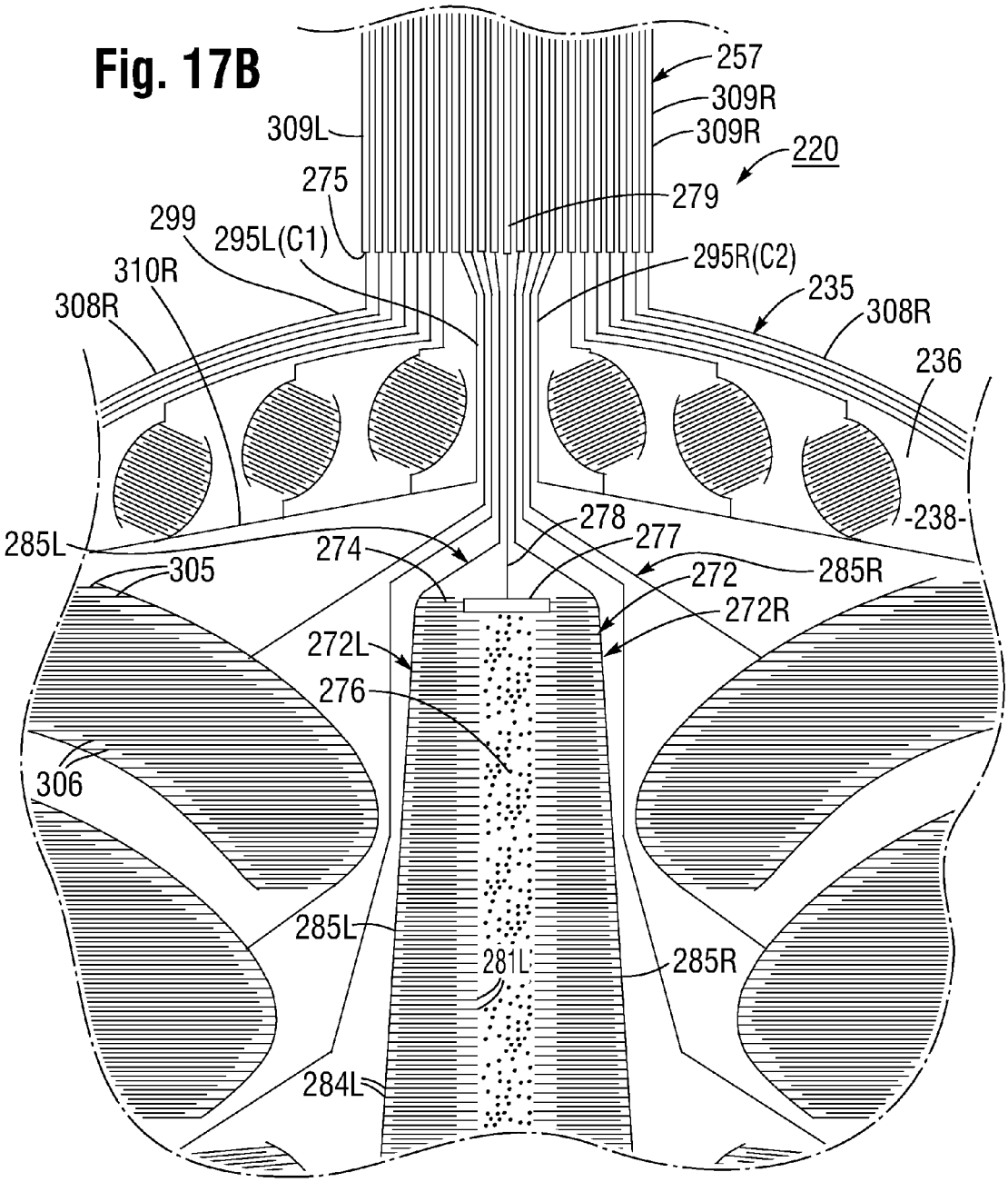
FIG. 17B is a fragmentary view of the electrode lamination of FIG. 17A, on an enlarged scale.

As shown in FIGS. 17A and 17B, electronic drumhead 220 has a rectangularly shaped interface tail section 257 which protrudes radially outwards from the outer circumferential edge 299 of electrode lamination 236. The electrode lamination 236 of the example embodiment of the multi-zone drumhead 220 shown in FIG. 17A includes a central impact sensor 272 which has the shape of a longitudinally elongated regular trapezoid. Central impact sensor 272 has a longitudinally disposed center line that is collinear with a diameter of electrode lamination 236, and collinear with a longitudinally disposed center line of interface tail section 257. Central impact sensor 272 has a distal laterally disposed base edge 273 which is perpendicular to the longitudinal center line of the zone sensor, and a shorter proximal base edge 274 which is located closer to the inner transverse edge 275 of tail section 257.

Central impact sensor 272 has a construction and function which differ somewhat from those of previously described sensor assembly 24 and the peripheral sensors 271 on substrate sheet 236 of multi-zone electronic drumhead 220. Specifically, central impact sensor 272 functions as a pair of laterally spaced apart, longitudinally disposed linear force-sensing potentiometers 272L, 272R, which provide electrical output signals that are indicative of two separate impact force parameters, namely, the location where an impact force is exerted and the magnitude of the force.

As shown in FIGS. 17A, 17B and 17C, central impact sensor 272 includes a laterally centrally located longitudinally disposed rectangularly-shaped, longitudinally elongated planar resistor 276. Planar resistor 276 is formed by screen printing on lower surface 238 of substrate sheet 236 a thick coating of an electrically conductive ink containing electrically conductive carbon particles. The proximal transverse end 239 of planar resistor 276 is deposited on a previously screen printed conductive silver connector bar trace 277. Connector bar trace 277 has protruding perpendicularly outwards therefrom a centrally located, "switchable-bias-voltage" lead-out conductor trace 278 which is printed on the lower surface 238 of substrate sheet 236. Switchable bias voltage lead-out conductor trace 278 has a continuation 279 which is printed on the surface of lead-out tail section 257. Switchable bias voltage lead-out conductor 279 is laterally centered on lead-out tail section 257, and extends to the outer transversely disposed edge 280 of the lead-out tail section.

As shown in FIGS. 17A, 17B and 17C, central impact sensor 272, has along left and right longitudinally disposed sides thereof left and right sensor halves 272L, 272R, each consisting of a plurality of thin, straight rectangular shaped interdigitated, laterally disposed spaced apart electrode traces. The traces include inner traces 281 which are overprinted and electrically conductively connected at laterally inwardly located ends 282 thereof to thick film planar resistor 276.

Central impact sensor 272 also has outer straight, thin rectangular shaped laterally disposed outer electrode traces 284 which are interdigitated with and spaced apart from inner electrode traces 281. The outer electrode traces 284 include left-hand outer traces 284L which extend laterally outwards towards the left-hand side of the central impact sensor 272, and right-hand outer traces 284R which extend laterally outwards towards the right side of the right-hand side of the central impact sensor. The outer edges of left-hand outer electrode traces 284 are electrically conductively connected to a longitudinally disposed left center sensor signal conductor lead-out 285L trace which extends outward on the interface tail section 257, along the left-hand side of switchable bias voltage lead-out conductor strip 279. Similarly, the outer edges of right-hand outer electrode traces 284R are electrically conductively connected to a longitudinally disposed, right center sensor signal lead-out trace 285R which extends outward on the interface tail section 257, on the right-hand side of the switchable bias voltage lead-out conductor strip 279.

As shown in FIG. 17A, a distal rectangular, laterally disposed end portion of longitudinally disposed planar resistor 276 of central zone impact sensor 272 is screen printed on top of, i.e., over-printed, a previously screen printed silver "fixed-bias-voltage" connector bar trace 291. Fixed-bias-voltage connector bar trace 291 has the shape of a thin, rectangularly-shaped strip disposed laterally between opposite sides of central zone impact sensor 272. Fixed-bias-voltage connector bar trace 291 has protruding laterally outwards from opposite ends of its distal or lower laterally disposed edge 292 left and right fixed bias voltage lead-out conductor traces 293, 294, which are collinear with the lower edge.

Left and right fixed bias voltage lead-out connector traces 293, 294 are disposed laterally away from central impact sensor 272 towards peripheral sensors 271 spaced away from the central impact sensor. The fixed-bias-voltage lead-out connector traces 293, 294 follow zig-zag paths and are connected to bias voltage electrode buses of the peripheral sensors 271, ultimately ending in straight and parallel left and right lead-out conductor strips 295L (C1), 295R (C2) which are printed on the surface of lead-out tail section 257, and extend to outer transversely disposed edge 280 of the lead-out tail section 257.

Figure 18:
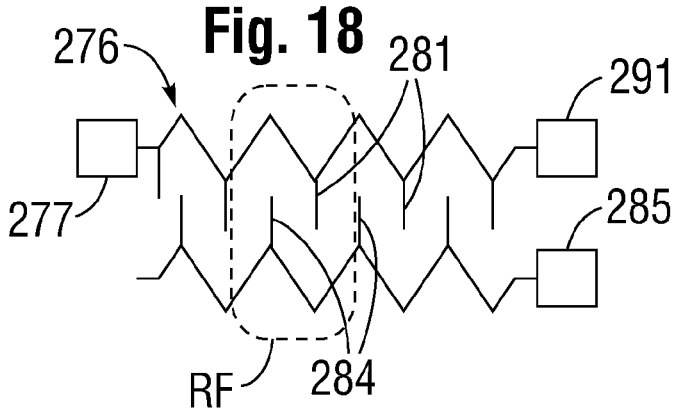
FIG. 18 is a schematic diagram of a central force and position sensor of the electrode lamination of FIG. 17A.
Figure 19:
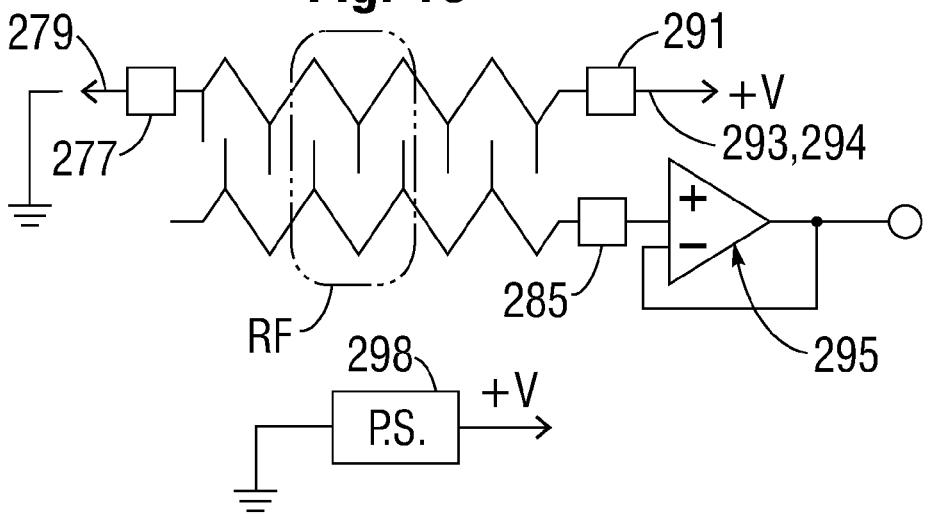
FIG. 19 is a schematic diagram of circuitry for determining position of a force exerted on the force and position sensor of FIG. 18.
Figure 20:
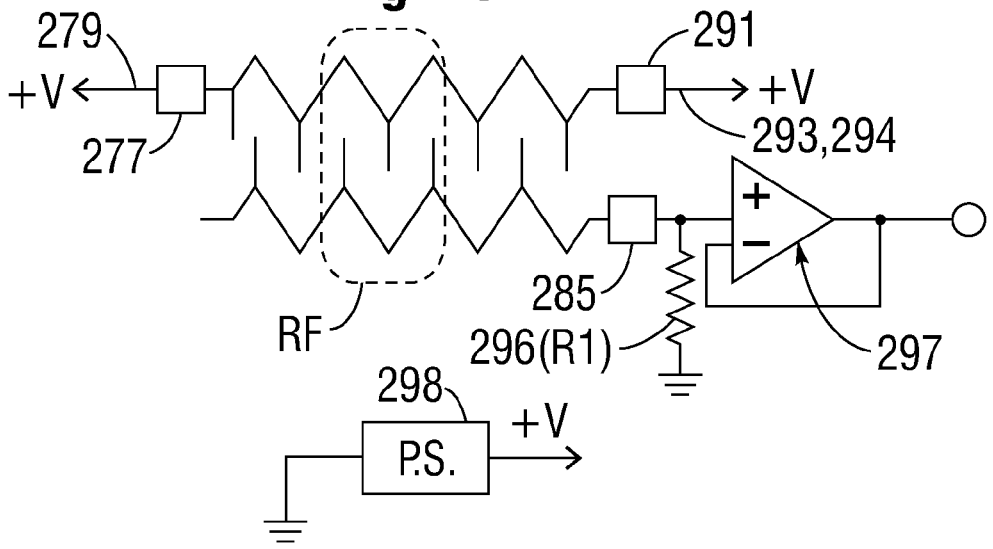
FIG. 20 is a schematic diagram of circuitry for determining the magnitude of a force exerted on the force and position sensor of FIG. 18.

FIGS. 18, 19 and 20 illustrate how each central impact sensor 272L, 272R provides two different electrical signals in response to impact forces on the sensors, namely, a first signal proportional to the longitudinal location of an impact force on the surface of left or right zone sensors 272,L, 272R, and a second signal proportional to the magnitude of the impact force.

As shown in FIG. 18, a schematic representation of a sensor 272L or 272R includes the longitudinally elongated rectangular thick film planar resistor 276 which is overprinted on proximal and distal silver end connector bar traces 277 and 291, which are electrically conductively connected to switchable bias voltage lead-out conductor 279, and fixed bias voltage lead-out conductors 293-294, respectively.

The schematic diagram, FIG. 18, also shows a force sensitive resistor RF, which represents electrically conductive contact of left or right columns of interdigitated electrodes 281 and 284 of sensor 272 with an FSR coating of force sensitive resistive ink on an FSR lamination (not shown) which confronts electrode lamination 236.

Referring to FIG. 19, it may be seen that in a first, position-sensitive mode of operation, position and force sensor 272 has a voltage of, for example, 6 volts applied between fixed bias voltage terminal 293-294 and switchable bias voltage terminal 279 of planar resistor 276. The signal lead-out terminal 285L, 285R of each sensor 272L, 272R is connected to the non-inverting input terminal of a separate operational amplifier 295L, 295R.

Each operational amplifier 295L, 295R is configured as a voltage follower, which characteristically has a very high electrical input impedance. Thus, when interdigitated electrode strips 281, 284 of a sensor 272L, 272R are pressed in response to an impact force against an FSR coating, a voltage pulse occurs on terminal 285L, 285R and on the input terminal of the operational amplifier 295L, 295R. The voltage ranges from 0 volts for a force exerted at the upper end of the sensor, to +V for a force exerted at the distal lower end of the sensor, depending upon where along the sensor the impact force is exerted.

The resistance RF between the electrode strips 281, 284 and the FSR layer varies with applied force, and can be as large as several thousand ohms. However, the impedance of operational amplifier 295 is selected to be several orders of magnitude greater than the equivalent resistance of the thick film resistor 276 and its contact resistance RF with the FSR coating. Thus, the voltage at the output terminal of the operational amplifier 295 is a function only of the longitudinal location of a force exerted on sensor 272, and is independent of the magnitude of that force.

To measure the magnitude of a force exerted on central impact sensor 272L, 272R, the circuit configuration shown in FIG. 20 is used. In this circuit configuration, one terminal of a voltage source, of, for example of +6 volts is connected to ground and the other terminal is connected to both switchable bias voltage terminal 279 and fixed bias voltage terminal 293-294 of planar resistor 276, thus making the entire longitudinally disposed surface of the planar resistor an equipotential surface.

As shown in FIG. 20, a fixed resistor 296 (R1) of a predetermined value is connected between the non-inverting input terminal of an operational amplifier 297L, 297R and the ground return side of a power supply 298, which is the positive bias voltage source for the planar resistor 276. The non-inverting input terminal of the operational amplifier 297L, 297R is also connected to the outer signal bus 285L, 285R of a left-hand or right-hand linear position sensor 272L, 272R. Thus, as shown in FIG. 20, the voltage at the input terminal of an operational amplifier 297L, 297R will be $V(R_1/R_1+R_F)$, which is proportional to the force exerted on the FSR coating by the interdigitated electrodes.

As will be understood by those skilled in the art, the circuit configurations shown in FIGS. 19 and 20 may be quickly switched between using electronic multiplexing circuitry, so that position can be measured using the circuit configuration in FIG. 19, and the circuit rapidly re-configured to the circuit configuration shown in FIG. 20, to measure force. The multiplexer switching rate is chosen to be faster than the rate at which forces on sensor 272 will be varied in response to movements of fingers or hands on the surface of the sensor.

Signals output from the operational amplifiers 295, 297 shown in FIGS. 19 and 20 are preferably input into two different signal processing circuits. For example, the position-sensitive output signal from the operational amplifier 295 shown in FIG. 19 may be used to control the fundamental frequency of a synthesized output signal. The force sensitive operational amplifier configuration shown in FIG. 20 may be used to control the amplitude of a synthesized signal. Thus, four operational amplifiers may be used to produce left and right, stereophonic audio signals varying in frequency and amplitude in response to fingers drawn across or pressed against various longitudinally disposed locations of left and right central zone sensors 272L, 272R.

Referring again to FIG. 17A, it may be seen that electrode lamination substrate 236 has on lower surface 238 thereof force-only impact sensors 271 located between central force and position impact sensors 272L, 272R and the outer circumferential edge or periphery 299 of the electrode lamination. As shown in FIG. 17A, the peripheral impact sensors 271 consist of left and right mirror symmetric pairs of sensors located on left and right sides of the longitudinal center line of central impact sensor 272, which as stated above, lies along a diameter of electrode lamination 236.

The peripheral impact sensors 271 include left and right longitudinally elongated rectangular-shaped center end zone impact sensors 302L, 302R. The rectangular center end zone impact sensors 302L, 302R are approximately aligned with and spaced longitudinally away from the base of the central impact sensors 272L, 272R, and extend to a distal segment 303 of the outer circumferential edge 299 of electrode lamination 236.

As shown in FIGS. 17A and 17D, each rectangular center end zone impact sensor 302L, 302R has a longitudinally disposed inner conductive signal bus trace 304L, 304R. Each signal bus trace 304L, 304R has the shape of thin, straight rectangular strip which is disposed along opposite sides of a diameter of electrode lamination 236, which is collinear with the longitudinal center line of central impact zone sensor 272. The signal bus traces 304L, 304R extend the entire lengths of rectangular center end zone impact sensors 302L, 302R.

Each rectangular center end zone impact sensor 302L, 302R also includes a plurality of inner rectangular-shaped inner sensor electrode traces 305L, 305R, respectively, which are continuous with and disposed laterally outwards from inner longitudinally disposed electrically conductive signal bus traces 304L, 304R, respectively. Also, each rectangular center end zone impact sensor 302L, 302R includes a plurality of thin, rectangular, laterally disposed outer sensor electrode traces 306L, 306R which are interdigitated with and spaced apart from the inner sensor electrode traces 305L, 305A. The outer sensor electrode traces 305L, 306R are continuous at laterally outwardly located ends thereof with outer longitudinally disposed bias voltage bus traces 307L, 307R, respectively.

As shown in FIG. 17A, the inner longitudinally disposed segment of signal bus trace 304L of left-hand center end zone sensor 272L continues at a front, distal end thereof as a semi-circularly curved annular segment 308L adjacent to the left-hand side of the outer circumferential edge 299 of electrode lamination 236. A rear, proximal end of curved signal bus trace segment 308L continues as a straight lead-out trace 309L which is printed on the surface of lead-out tail section 257, adjacent to the left-hand edge of the lead-out tail section.

As is also shown in FIG. 17A, the outer longitudinally disposed, fixed-bias-voltage bus trace 307L of left-hand rectangular center end zone impact sensor 302L continues at a rear longitudinal end thereof in a uniform width, fixed-bias-voltage bus trace that connects to lead-out conductor strip 295, which follows a zig-zag path over the lower surface of the left side of electrode lamination sheet 236. Zig-zag bias voltage bus trace 295L continues at a rear end located near lead-out tail section 257 in a straight lead-out trace 295L (CIL) printed on the lower surface of the lead-out tail section.

As shown in FIG. 17A, electrode lamination 236 has 9 additional left-hand impact sensors 271 located peripherally to central impact sensor 272, and on the left side thereof, for a total of 10 left-hand peripheral sensors. Electrode lamination 236 also has on the right side thereof 10 right-hand peripheral impact sensors 271 which are mirror symmetric in shape and location to the left-hand sensors.

Each of the sensors 271 has a construction similar to that of rectangular end-zone sensors 302L, 302R. Thus, each peripheral sensor 271 has a first set of laterally disposed, thin rectangular electrode strips which extend laterally from a first, bias voltage bus trace. Each peripheral sensor 271 also has a second set of laterally disposed, thin rectangular electrode strips which extend from a second, output signal trace towards the first set of output signal electrode strips, interdigitated with and spaced apart from said first set of electrode strips.

The output signal bus trace of each peripheral sensor 271 is connected to a separate lead-out conductor on lead-out tail section 257. The bias voltage bus trace of each sensor 271 is connected to a common lead-out conductor or lead-out strip. Consequently, when the conductive surfaces of the interdigitated electrodes are brought into contact with the force sensing ink coating on the surface of an FSR lamination, electrical conductance measured between a pair of lead-out conductors of a sensor, consisting of a bias voltage bus and output signal bus, increases proportionately to impact forces on the outer surface of the electrode lamination 235 or on the outer surface of an FSR lamination, such as an FSR lamination 28 shown in FIG. 7, confronting the electrode lamination.

According to the invention, the pair of signal lead-outs from each of the 10 left and 10 right peripheral sensors 271 is connected to a separate channel of an electronic signal processing module, similar in structure and function to electronic interface module 70 shown in FIG. 10 and described above. Preferably, the signal processor channel 76 of each of the 20 different force-only sensors produces a distinct, adjustable parameter audio frequency signal which is uniquely associated with a separate one of the 20 peripheral zones on multi-zone drumhead 220.

Figure 21:
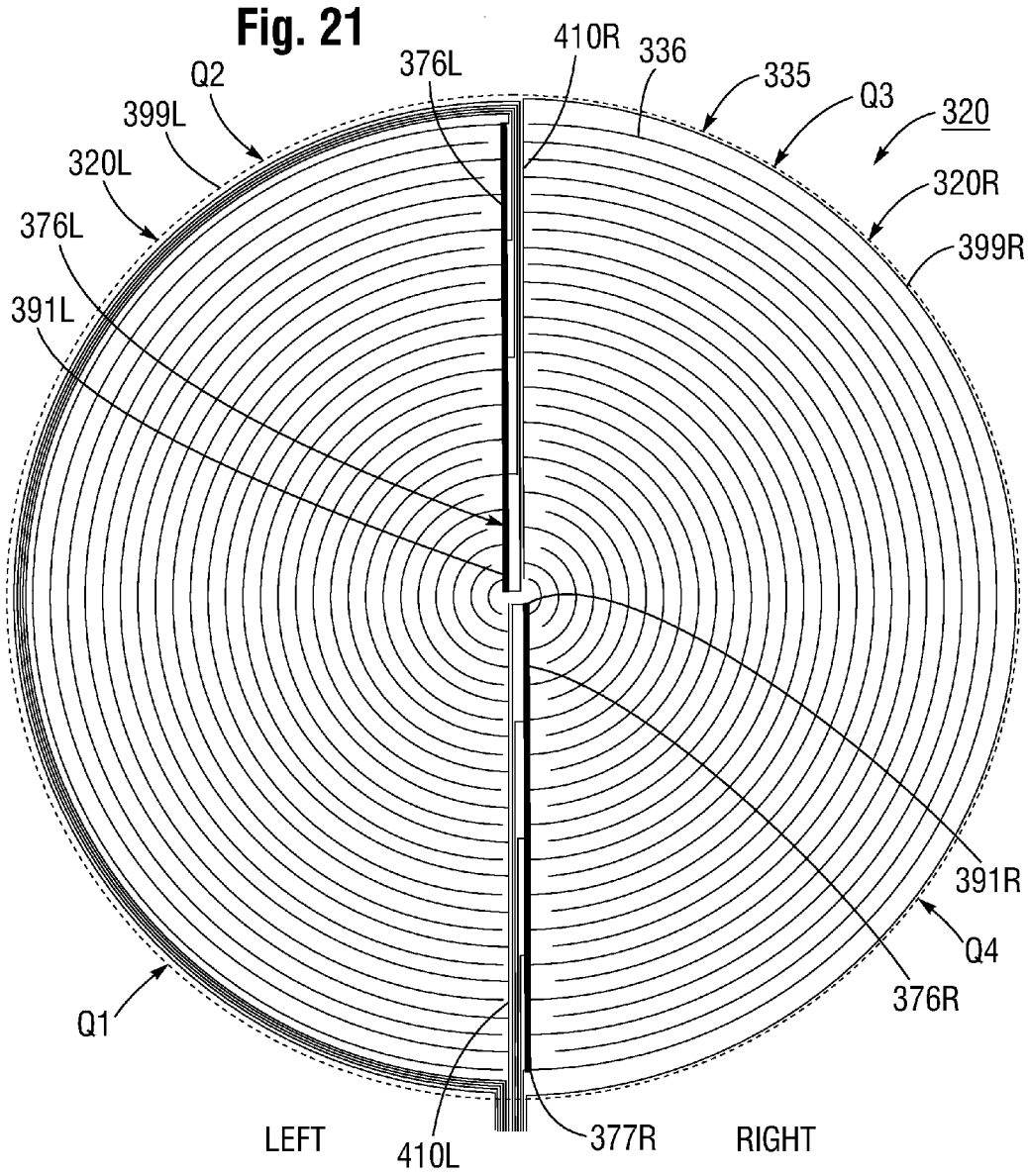
FIG. 21 is a lower plan view of electrode lamination for a multiple concentric zone modification of the drumhead shown in FIGS. 1 and 17A, which has force and position sensing linear potentiometers.

Also, the output ports 77 of each of the 20 peripheral signal processor channels 76 are preferably input to separate input terminals of a summing amplifier, as shown in FIG. 21, which in turn has an output port 77 connected to an external output port 78 that is connectable to a loudspeaker or earphones.

Optionally, the 20 output ports of the 20 peripheral signal processors 70 may be input to and summed in multiple summing amplifiers such as left and right summing amplifiers for the left 10 peripheral sensors 271L, and the right 10 peripheral sensors 271R. Output signals from multiple amplifiers, e.g., left and right amplifiers, may then be input to spatially separated stereo headphones or loudspeakers.

In the embodiments of electronic drumheads according to the present invention which were described above, the impact sensors of each of the drumheads included pairs of interdigitated electrodes which were printed on a common planar surface of an electrode lamination which confronted a coating of a force sensitive electrically conductive ink applied to a facing surface of an FSR (force sensing resistor) lamination. Electronic drumhead sensors of this type may be described as "shunt-mode" sensors, since essentially infinite resistance paths between interdigitated electrodes on a common surface are shunted by electricity conductive paths in the FSR coating when pairs of the sensor electrodes are pressed into contact with the FSR coating.

According to the invention, the force sensing sensors may optionally be constructed as "through-mode" sensors. In this construction mode, a first set of spaced part sensor electrodes is printed on an inner planar surface of a first electrode lamination, and a second set of electrodes printed on an inner surface of a second electrode lamination which confronts the first electrode lamination. The first and second sets of electrodes are arranged so that they form a pattern of spaced apart, interdigitated electrodes when the first and second electrode laminations are joined together in a vertically aligned and indexed stack. Before the two electrode laminations are joined together to form a completed sensor assembly, an FSR coating is overprinted on top of the printed electrode traces of one or both of the two electrode laminations.

Figure 22A:
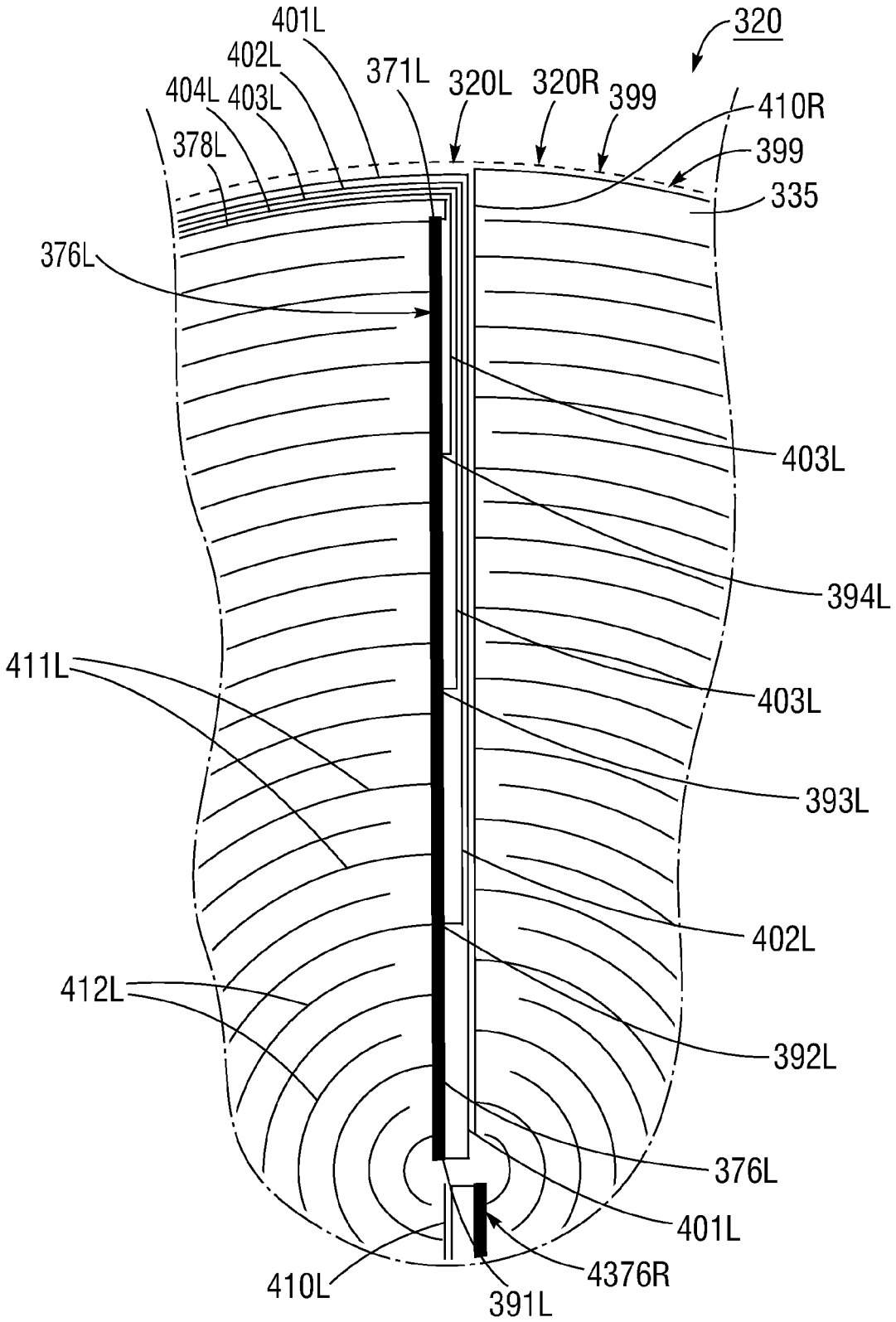
FIG. 22A is a fragmentary view of an upper left-hand quadrant of the drumhead of FIG. 21, on an enlarged scale.
Figure 22B:
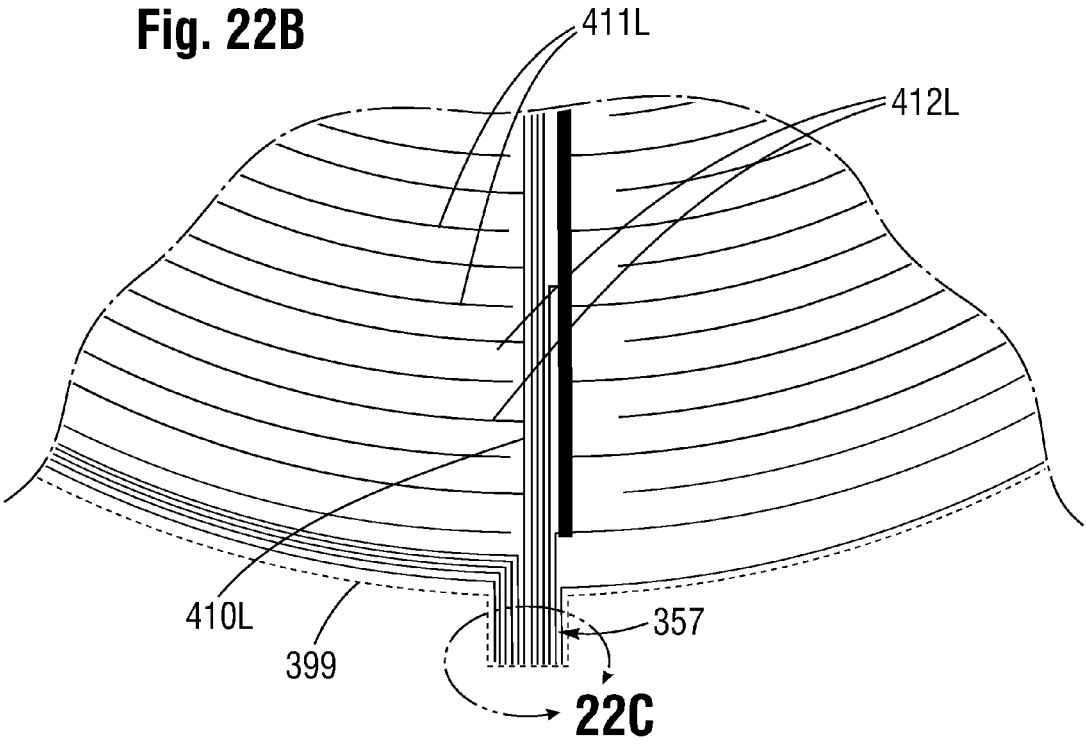
FIG. 22B is a fragmentary view on an enlarged scale of a lower half of the drumhead of FIG. 21.
Figure 22C:
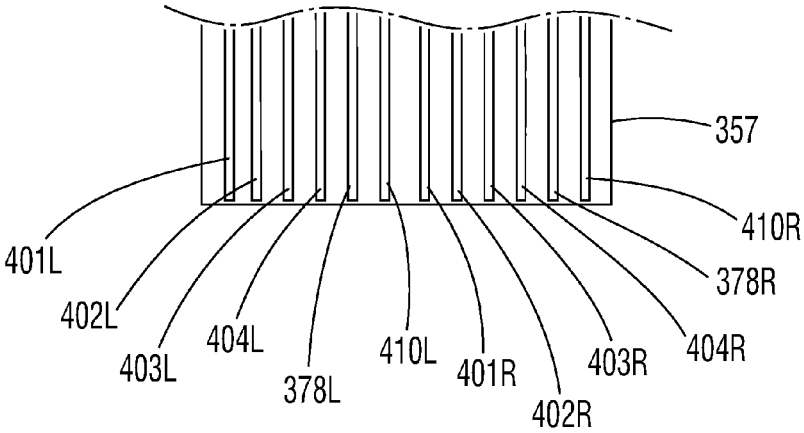
FIG. 22C is a further enlarged view of FIG. 22B, showing a lead-out tail section of the drumhead.
Figure 23:
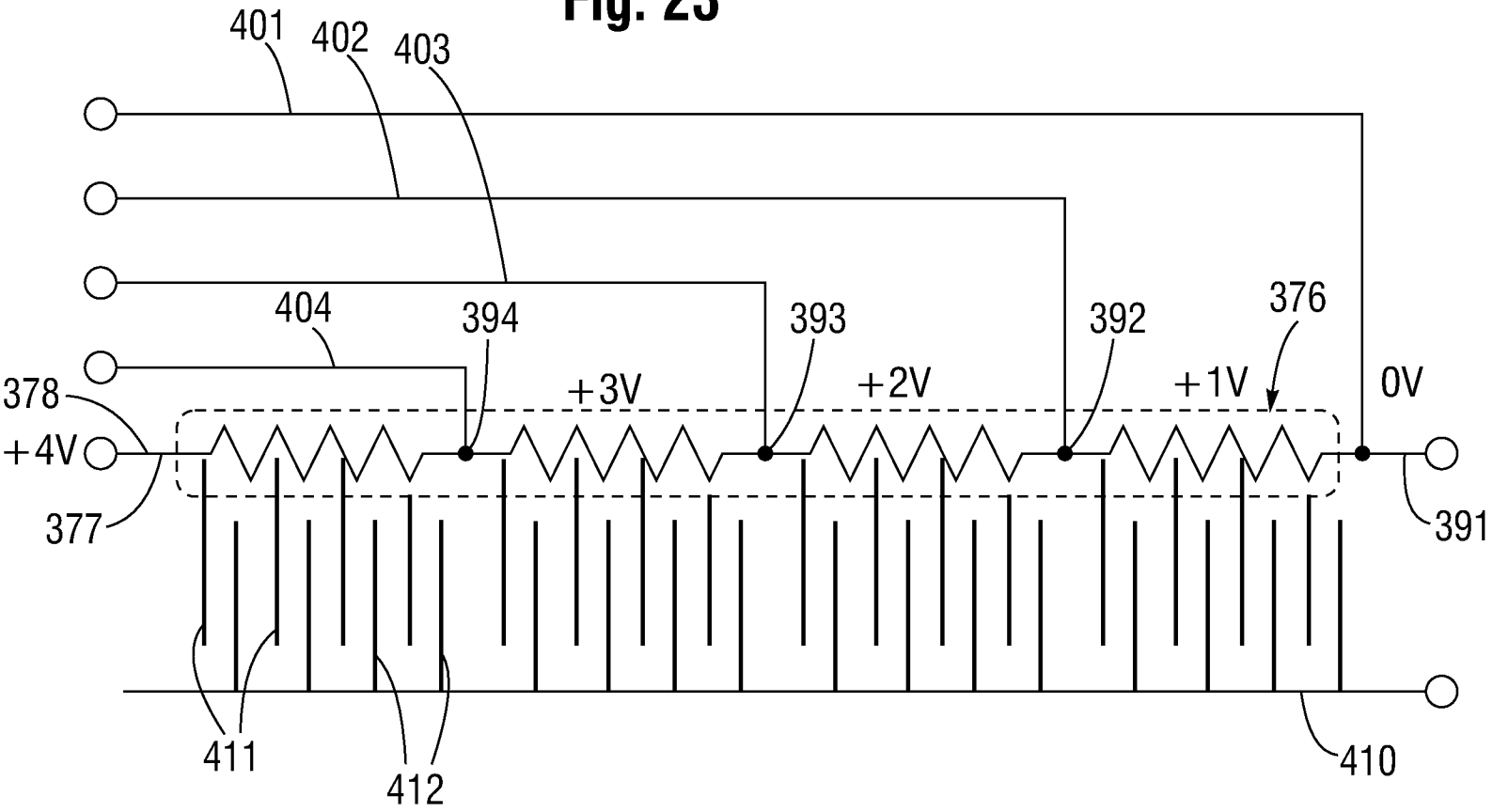
FIG. 23 is a schematic diagram of sensor elements of the drumhead of FIG. 21.

FIGS. 21-23 illustrate another modification 320 of electronic drumhead 20 shown in FIGS. 1-10 and described above. Modified drumhead 320 has multiple concentric force and position sensitive sensor zones. Modified electronic drumhead 320 is similar to drumhead 20, but has a pair of diametrically opposed radially disposed, screen-printed planar linear resistors 376L, 376R which are located in left and right halves 320L, 320R. The planar linear resistors are used to locate the radial location, i.e., distance from the center, of a drumstick impact on the surface of the drumhead. Thus the construction and function of planar resistors 376L, 376R are similar to that of linear resistors 276 used as a linear potentiometer in electronic drumhead 220 described above. However, as shown in the enlarged views of FIGS. 222A and 222B, and the schematic diagram of electronic drumhead 320 shown in FIG. 23, the linear potentiometer resistors 376L, 376R each have in addition to a switchable bias voltage conductor bar 377L, 377R at an outer end of the resistor, and a first fixed bias voltage connector bus 391L, 391R at the inner end of each resistor, three additional intermediate conductor bar taps located between opposite ends of a linear potentiometer resistor. Switchable bias voltage connector bar 377L, 377R each has protruding radially outwards therefrom a lead-out conductor trace 378L, 378R, respectively. Lead-out conductor trace 378L continues in a semi-circular path along the left-hand semi-circumference of electrode lamination 336.

As shown in FIGS. 22A and 23, each linear planar resistor 376L, 376R includes at a radially inwardly located inner end thereof near the center of a circular electrode lamination 336 a first, fixed bias voltage connector bar 391L, 391R, which has a short segment extending laterally outwardly and a longer segment extending radially outwards parallel to the resistor 376L, 376R a first lead-out trace 401L, 401R. Lead-out trace 401L, extends in a straight line towards the outer circumferential edge 399 of electrode lamination 335, and thence continues in a semi-circular path along the left-hand semi-circular half of the outer circumferential edge 399L of electrode lamination 335.

As is also shown in FIGS. 22A and 23, left-hand planar resistor 376 has spaced radially outwards at equal intervals from inner end connector bar 391L thereof three additional connector bars 392L, 393L, and 394L, which, with switchable bias voltage connector bar 377L located at the radially outwardly located end of left-hand planar resistor 376, form four concentric sensor zones of equal width on the circular planar surface of electrode lamination 336. As may be understood by referring to FIG. 23 in addition to FIG. 21, each of the four left-hand semi-circular sensor zones is responsive to both force and position.

As shown in FIGS. 22A and 23, each of the three additional voltage tap connector bars 392L, 393L, 394 and the switchable bias voltage connector bar 377L at the outer end of planar resistor 376L have electricity connected to them individual bus lines 402L, 403L, and 404L, respectively. The latter three bus lines are parallel to lead-out trace 401L, and are disposed radially outwards towards the outer circumferential edge 399 of substrate lamination sheet 336, continuing in parallel semi-circular paths along the left-hand semi-circumference of electrode lamination 336, and onto the upper surface of a rectangular lead-out tail section 357 which extends radially outwards from the outer circumferential edge of the substrate lamination sheet.

As shown in FIGS. 21 and 22B, the lower or proximal left-hand quadrant Q1 of electrode lamination substrate sheet disk 336 has disposed along a radius collinear with left-hand planar resistor 376 a common bus trace 410L. Common bus trace 410L extends radially outwards from electrode lamination substrate sheet 336 on the upper surface of lead-out tail section 357.

As shown schematically in FIGS. 21, 22A, 22B and 23, left-hand linear planar resistor 376 has protruding from a left-hand side thereof a series of thin, uniform width, curved silver resistor-end, semi-circular electrode traces 411L which are spaced apart at regular radial intervals. The remote end of each of the resistor-end electrode traces terminates in the lower left-hand quadrant Q1 of electrode lamination 336 and is spaced circumferentially from and thus electrically isolated from the left-hand edge of left-hand common bias trace 410L.

Similarly, left-hand common bias trace 410L has protruding from a left side thereof a series of semi-circularly curved, thin, uniform width common bias electrode traces 412L. The remote end of each of the common bias electrode traces 412 terminates in the upper left-hand quadrant Q2 of electrode lamination and is spaced circumferentially from and thus electrically isolated from the left-hand edge of planar resistor 376L. Common electrode traces 412L are interdigitated with and centered between in a spaced apart relationship to resistor-end electrode trace 411L.

As may be understood by referring to FIG. 21, drumhead 320 includes left and right halves 320L, 320R, each having a semi-circular shape. As may be understood by referring to FIGS. 21, 22A, 22B and 22C, the topology and construction of right-hand sensor elements of drumhead 320R are identical to those of sensor elements of left-hand semi-circular half 320L, rotated 180 degrees to thus orient the two quadrants Q1, Q2 in quadrant positions Q3, Q4, respectively.

As shown in FIG. 21, electronic drumhead 320 has left and right sensor halve 320L, 320R, each having the shape of half of a circular disk. Each of the two sensor halves has multiple radially spaced apart concentric sensor zones which are capable of producing electronic signals which are indicative of the radial location of a drumstick impact as well as the magnitude of the impact force. Drumhead 320 may optionally fabricated to have a single circular disk-shaped sensor with multiple radially spaced apart concentric sensor zones by deleting one of the two planar resistors, for example, 376R, deleting right-hand common bus trace 410R, and extending semi-circular electrode traces 411L, 412 L nearly 180 degrees counter-clockwise from quadrant Q1 to quadrant Q3.

Figure 24:
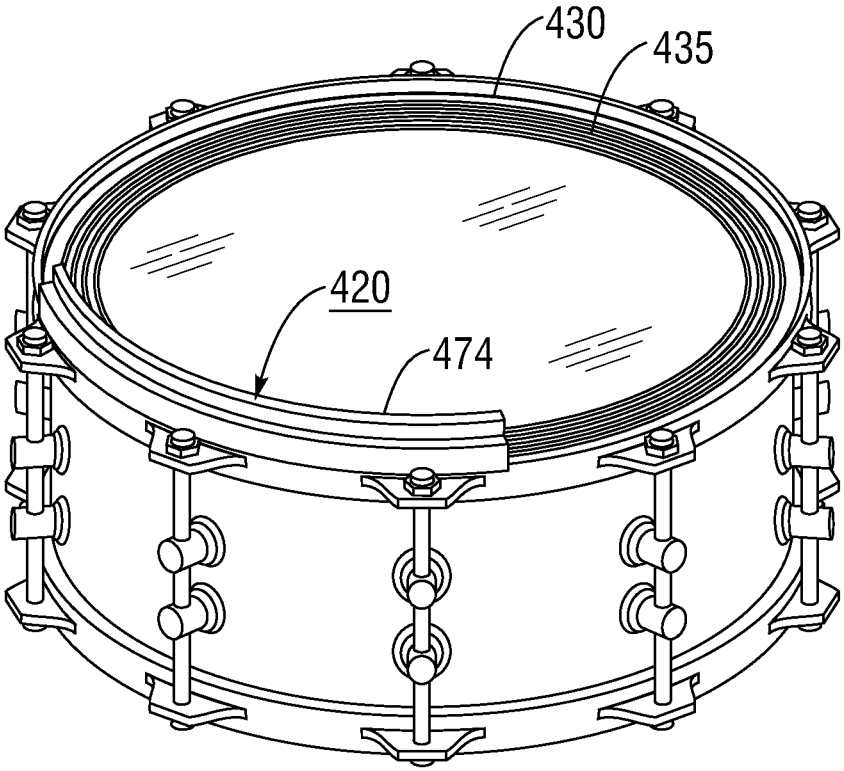
FIG. 24 is a perspective view of another modification of the electronic drumhead of FIGS. 1-10 which is responsive to rimshot drumstick impacts, showing the drumhead mounted to a drum.
Figure 25:
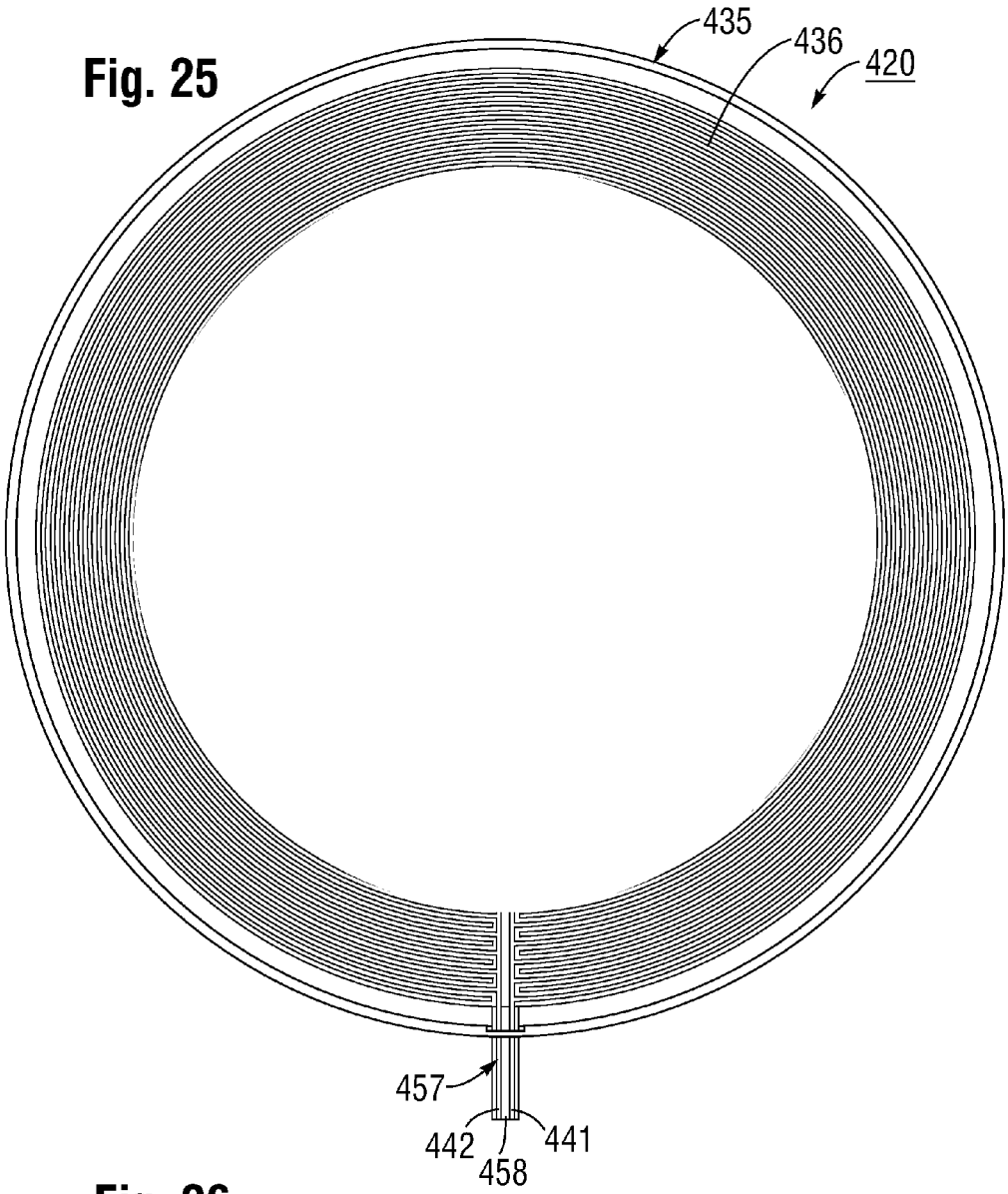
FIG. 25 is a plan view of an electrode lamination of the rimshot modification of FIG. 24.
Figure 26:
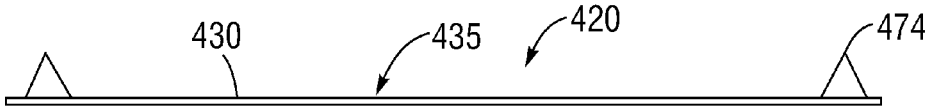
FIG. 26 is a side elevation view of the rimshot modification of FIG. 24.

FIGS. 24-26 illustrate a RimShot modification of the electronic drumhead of FIGS. 1-10, which is suitable for mounting on the upper surface of the electronic drumhead shown in FIGS. 1-10, or alternatively on the upper surface of a tensioned drumhead.

As shown in FIGS. 24-26, electronic rimshot responsive drumhead 420 includes an electrode lamination 435 which consists essentially of a flat annular ring-shaped member which is substantially similar in construction and function to that of the other annular ring-shaped section of electronic drumhead 20 shown in FIG. 14 and described above.

As may be seen best by referring to FIGS. 24 and 26, electrode lamination 435 has fastened to the upper surface 430 thereof a crescent-shaped rimshot impact bumper 474 which has the shape of a segment of an annular ring, and a uniform triangular transverse cross section. The rimshot impact bumper 474 is made of a durable, impact resistant polymer which may be a thermoplastic or an elastomer such as polyurethane. According to the invention, a lead-out conductor tail 457 of the accessory 420 is electrically coupled to a signal processor 470 similar to signal processor 70 shown in FIG. 10, which is effective in converting electrical impulse signals produced in a sensor assembly 424 of the accessory into audio frequency signals which simulate the sounds of a drumstick impacting a drum rim.

What is claimed is:

1. A portable electronic drumhead sensor for converting drumstick impacts thereon to electrical pulses, said sensor comprising a thin, uniform thickness laminated disk which has parallel planar outer surfaces, said laminated disk including;

a. a first, FSR lamination sheet which has an outer planar surface and an inner planar surface having thereon a coating of an electrically conductive substance, said coating comprising a force sensing electrical resistor (FSR) layer, b. a second, electrode lamination sheet which has an outer planar surface and an inner planar surface having thereon a pair of electrically isolated, spaced apart electrode strips, said electrode strips having electrically conductive outer surfaces contactable with said FSR layer, c. at least a first spacer member positioned between inner facing surfaces of said FSR lamination sheet and said electrode lamination sheet, said spacer member biasing said inner facing surfaces of said first and second lamination sheets away from each other, at least one of said first and second lamination sheets being elastically flexible towards the other to thus enable mutual electrically conductive contact between said inner facing surfaces of said first and second lamination sheets in response to a drumstick impact on an outer surface of either one of said first and second lamination sheets, said first and second lamination sheets and said spacer member being arranged parallel to each other, stacked in a direction normal to said contactable surfaces, and fixed in position to form said laminated disk having first and second parallel planar outer surfaces, d. said first and second lamination sheets having material properties sufficiently similar to thereby produce similar electrical conductance variations between said electrode strips in response to impacts on an outer surface of either one of said first and second lamination sheets, whereby said laminated disk is positionable alternatively on an acoustic drumhead or a rigid support with either of said outer surfaces of said first, FSR lamination sheet or said second, electrode lamination sheet facing upwards to thus produce electrical signals responsive to impacts on either of said outer surfaces, and e. a pair of lead-out conductors extending exteriorly of said mutually electrically contactable regions of said electrode lamination sheet and said FSR lamination sheet, said lead out conductors electrically conductively contacting separate ones of said electrode strips.

2. The drumhead sensor of claim 1 further including a resilient sound deadening batter pad overlying an outer surface of one of said electrode lamination sheet and said FSR lamination sheet.

3. The drumhead sensor of claim 2 wherein at least part of said batter pad is an made of an elastomeric material.

4. The drumhead sensor of claim 2 further including an impact alteration resistant overlay sheet overlying said batter pad.

5. The drumhead sensor of claim 4 wherein said overlay sheet is further defined as a thin sheet of acrylic coated fabric adhesively adhered to said batter pad.

6. A portable electronic drumhead including the drumhead sensor of claim 2 and a rigid baseboard underlying the other one of said electrode lamination sheet and said FSR lamination sheet.

7. The portable electronic drumhead of claim 6 further including a resilient sound absorbing pad underlying said baseboard.

8. The portable electronic drumhead of claim 7 wherein at least part of said batter pad is made of an elastomeric material.

9. The portable electronic drumhead sensor of claim 1 wherein said electrode strips are arranged in a pattern spaced inwards of an outer peripheral edge of said electrode lamination.

10. The portable electronic drumhead of claim 9 wherein said pattern is further defined as including a first set of radially spaced apart concentric circular arc segments connected to a first one of said lead-out conductors and a second set of radially spaced apart circular arc segments concentric with and interdigitated with said first set of circular arc segments and connected to a second one of said lead-out conductors.

11. The portable electronic drumhead of claim 10 wherein said lead-out conductors are disposed radially outwards of said pattern of electrode strips.

12. The portable electronic drumhead of claim 11 wherein said pattern of electrode strips is further defined as having a circular disk-shape.

13. The portable electronic drumhead of claim 11 wherein said pattern of electrode strips is further defined as having a flat annular ring shape having a circular outer circumferential edge.

14. The portable electronic drumhead of claim 13 further including a rimshot impact bumper fastened to the upper surface of said flat annular ring-shaped electrode strip pattern.

15. The portable electronic drumhead of claim 11 wherein said lead-out conductors are disposed through an aperture through said base board.

16. The drumhead sensor of claim 1 wherein said FSR layer is further defined as an including an electrically conductive polymer ink.

17. The drumhead sensor of claim 1 further including an electronic interface module for converting into electrical pulses changes in electrical resistance of a series circuit comprising a first electrode strip of said pair of electrode strips, an area of said FSR layer, and a second electrode strip of said pair of electrode strips, said interface module including a voltage source and an electrical resistor connected in series with said lead-out conductors.

18. The drumhead sensor of claim 1 wherein said spacer member is further defined as including a third, spacer lamination positioned between said FSR lamination sheet and said electrode lamination sheet.

19. The drumhead sensor of claim 18 further including a plurality of spaced apart electrically insulating members disposed between said electrode strips and said FSR layer.

20. The drumhead sensor of claim 19 wherein said insulating members are further defined as being dielectric dots.

21. The drumhead sensor of claim 20 wherein said dielectric dots have a diameter in the approximate range of about 6.35 mm to about 9 mm.

22. The drumhead sensor of claim 21 wherein the area density of said dielectric dots is about 8 dots per square cm.

23. The drumhead sensor of claim 22 wherein said dots have an arcuately curved, convex outer surface.

24. The drumhead sensor of claim 23 wherein said dots are composed of UV or solvent-cured ink.

25. The drumhead sensor of claim 1 wherein at least one of said first and second lamination sheets has through its thickness dimension an air bleed hole which communicates with a space interior to said spacer.

26. A portable electronic drumhead for converting drumstick impacts thereon to electrical pulses, said drumhead comprising;

a. a sensor comprising a thin, uniform thickness laminated disk which has parallel planar outer surfaces, said laminated disk including:

i. a first, FSR lamination sheet which has an outer planar surface and an inner planar surface having thereon a coating of an electrically conductive substance, said coating comprising a force sensing resistance (FSR) layer, ii. a second, electrode lamination sheet which has an outer planar surface and an inner planar surface having thereon a pair of electrically isolated, spaced apart electrode strips, said electrode strips having electrically conductive outer surfaces contactable with said FSR layer, and iii. a third, spacer lamination positioned between inner facing surfaces of said FSR lamination sheet and said electrode lamination sheet, said spacer lamination biasing said inner facing surfaces away from each other, at least one of said first and second lamination sheets being elastically flexible towards the other to thus enable mutual contact between said inner facing surfaces of said first and second lamination sheets in response to a drumstick impact on an outer surface of either one of said first and second lamination sheets, said first, second and third lamination sheets being arranged parallel to each other, stacked in a direction normal to said contactable surfaces, and fixed in position to form a laminated assembly having first and second parallel planar outer surfaces, iv. a pair of lead-out conductors extending exteriorly of said mutually electrically contactable regions of said electrode lamination sheet and said FSR lamination sheet, said lead out conductors electrically conductively contacting to separate ones of said electrode strips, v. said first and second lamination sheets having material properties sufficiently similar to thereby produce similar electrical conductance variations between said electrode strips in response to impacts on an outer surface of either one of said first and second lamination sheets, whereby said laminated disk is positionable with either of said outer surfaces of said first, FSR lamination sheet or said second, electrode lamination sheet facing upwards to thus produce electrical signals responsive to impacts on either of said surfaces, b. a circular retainer hoop which circumscribes the outer circumferential edges of said first, second and third laminations of said sensor, and c. said portable electronic drumhead being positionable alternatively on an acoustic drumhead or a rigid support surface.

27. The portable electronic drumhead of claim 26 wherein said retainer hoop has protruding radially outwards from a lower part of the outer circumferential edge wall thereof an elastomeric ring shaped lower flange bead section.

28. The portable electronic drumhead of claim 26 wherein said lower bead section flange has a larger diameter transverse cross section than an upper part of said retainer hoop.

29. The portable electronic drumhead of claim 28 further including a sound deadening batter pad overlying an outer planar surface of an upper one of said first and second laminations.

30. The portable electronic drumhead of claim 29 wherein at least part of said batter pad is an made of an elastomeric material.

31. The portable electronic drumhead of claim 30 wherein said retainer hoop has protruding radially outwards from an upper part of the outer circumferential edge wall thereof an elastomeric ring shaped upper flange which has a radially inwardly located edge that overlies an outer circumferential edge of said batter pad.

32. The portable electronic drumhead of claim 31 further including an impact alteration resistant overlay sheet overlying said batter pad and underlying said upper bead section.

33. The portable electronic drumhead of claim 32 further including a resilient sound absorbing pad underlying a lower surface of a lower one of said first and second laminations.

34. The portable electronic drumhead of claim 33 wherein at least part of said sound absorbing pad is made of an elastomeric material.

35. The portable electronic drumhead of claim 34 wherein said lower flange has a radially inwardly located edge which underlies an outer circumferential edge of said sound absorbing pad.

36. The portable electronic drumhead of claim 35 further including a rigid base board located between an upper surface of said lower bead section and a lower surface of said base board.

37. A portable electronic drumhead sensor assembly for converting hand and finger impacts thereon to electrical pulses, said sensor assembly comprising;

a. a first, FSR lamination sheet which has an outer planar surface and an inner planar surface having thereon a coating of an electrically conductive substance, said coating comprising a force-sensing resistance (FSR) layer, b. a second, electrode lamination sheet which has an outer planar surface and an inner planar surface having thereon a plurality of spaced apart impact force-sensors, each of said impact force-sensors comprising, i. at least one pair of electrically isolated, spaced apart electrode strips, said electrode strips having electrically conductive surfaces contactable with said FSR layer, ii. at least a first spacer member positioned between inner facing surfaces of said FSR lamination sheet and said electrode lamination sheet, said spacer member biasing said inner facing surfaces of said first and second lamination sheets away from each other, at least one of said first and second lamination sheets being elastically flexible towards the other to thus enable mutual electrically conductive contact between said inner facing surfaces of said first and second lamination sheets in response to a drumstick impact on an outer surface of either one of said first and second lamination sheets, said first and second lamination sheets and said spacer member being arranged parallel to each other, stacked in a direction normal to said contactable surfaces, and fixed in position to form a laminated assembly having first and second parallel planar outer surfaces, and iii. a pair of lead-out conductors extending exteriorly of said mutually electrically contactable regions of said electrode lamination sheet and said FSR lamination sheet, said lead-out conductors electrically conductively contacting separate ones of said electrode strips, wherein said electrode strips of each sensor are further defined as including a first set of parallel spaced apart strips connected to a first one of said lead-out conductors and a second set of parallel spaced apart strips parallel to and interdigitated with said first set of electrode strips and connected to a second one of said lead-out conductors, and c. at least a first position and force sensor, said position and force sensor comprising:

i. an elongated planar resistor printed on said inner planar surface of said electrode lamination, said planar resistor having at a first end thereof a first transversely disposed connector bar electrically connected to a first bias voltage lead-out conductor and at a second end thereof a second transversely disposed connector bar electrically connected to a second bias voltage lead-out conductor, ii. a first set of inner parallel spaced apart electrode strips which protrude laterally outwards from a first longitudinally disposed side of said planar resistor, said electrode strips having inner ends in electrically conductive contact with said planar resistor, iii. a first set of outer parallel spaced part electrode strips spaced apart from and interdigitated with said first set of inner electrode strips, and iv. a first signal lead-out conductor electrically connected to said first set of outer electrode strips.

38. The electronic drumhead sensor assembly of claim 37 further including;

a. a second set of inner parallel spaced apart electrode strips which protrude laterally outwards from a second longitudinally disposed side of said planar resistor, said inner ends of said electrode strips being in electrically conductive contact with said planar resistor, b. a second set of outer parallel spaced apart electrode strips spaced apart from and interdigitated with said second set of inner electrodes, and c. a second signal lead-out conductor electrically connected to said second set of outer electrode strips.

39. A portable electronic drumhead sensor for converting drumstick impacts thereon to electrical pulses, said drumhead sensor comprising a uniform thickness laminated disk which has parallel planar outer surfaces, said laminated disk including;

a. a first, composite lamination sheet which has an outer planar surface and an inner planar surface having thereon a first set of electrically conductive electrode strips, said first set of electrode strips having on an outer planar surface thereof a coating of an electrically conductive substance, said coating comprising a force sensing electrical resistor (FSR) layer, b. a second, electrode lamination sheet which has an outer planar surface and an inner planar surface having thereon a second set of electrically isolated, spaced apart electrode strips, said electrode strips having electrically conductive outer surfaces contactable with said FSR layer, c. at least a first spacer member positioned between inner facing surfaces of said first, composite lamination sheet and said second, electrode lamination sheet, said spacer member biasing said inner facing surfaces of said first and second lamination sheets away from each other, at least one of said first and second lamination sheets being elastically flexible towards the other to thus enable mutual electrically conductive contact between said inner facing surfaces of said FSR coating on said first lamination sheet and said second set of electrode strips on said second lamination sheet in response to a drumstick impact on an outer surface of either one of said first and second lamination sheets, said first and second lamination sheets and said spacer member being arranged parallel to each other, stacked in a direction normal to said contactable surfaces, and fixed in position to form said laminated disk having first and second parallel planar outer surfaces, d. said first and second lamination sheets having material properties sufficiently similar to thereby produce similar electrical conductance variations between said electrode strips in response to impacts on an outer surface of either one of said first and second lamination sheets, whereby said laminated disk is positionable alternatively on an acoustic drumhead or a rigid support with either of said outer surfaces of said first, FSR lamination sheet or said second, electrode lamination sheet facing upwards to thus produce electrical signals responsive to impacts on either of said outer surfaces, and e. a pair of lead-out conductors extending exteriorly of said mutually electrically contactable regions of said electrode lamination sheet and said FSR lamination sheet, said lead out conductors electrically conductively contacting separate sets of said electrode strips.

40. The drumhead of claim 39 wherein said first and second sets of said electrode strips are arranged in a laterally offset, interdigitated pattern.

41. The drumhead sensor of claim 39 wherein at least one of said first and second lamination sheets has through its thickness dimension an air bleed hole which communicates with a space interior to said spacer.

* * * * *